US005158892A

United States Patent [19]

Sasaki et al.

[11] Patent Number: 5,158,892

[45] Date of Patent: Oct. 27, 1992

[54] SELENIUM SENSITIZERS FOR SILVER HALIDE PHOTOGRAPHIC MATERIALS

[75] Inventors: Hirotomo Sasaki; Tetunori Matushita; Hiroyuki Mifune; Mikio Ihama, all of Kanagawa, Japan

[73] Assignee: Fuji Photo Film Co., Ltd., Kanagawa, Japan

[21] Appl. No.: 753,138

[22] Filed: Aug. 30, 1991

[30] Foreign Application Priority Data

Aug. 30, 1990 [JP] Japan ..... 2-229300

[51] Int. Cl.[5] ..... G03C 1/08; G03C 1/34

[52] U.S. Cl. ..... 430/603; 430/605; 430/607

[58] Field of Search ..... 430/603, 605, 567, 607

[56] References Cited

U.S. PATENT DOCUMENTS

| | | | |
|---|---|---|---|
| 4,565,778 | 1/1986 | Miyamoto | 430/605 |
| 4,810,626 | 3/1989 | Burgmaier et al. | 430/603 |
| 5,004,679 | 4/1991 | Mifune et al. | 430/603 |

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

A silver halide photographic material comprising a support having thereon at least one silver halide emulsion layer, characterized in that at least one silver halide emulsion layer contains at least one compound represented by the following general formula (I), (II) or (III):

(I)

(II)

(III)

wherein Q, X, Y, $Z_1$, $Z_2$, A, $T_1$, $T_2$ and $T_3$ are as defined in the specification.

38 Claims, No Drawings

SELENIUM SENSITIZERS FOR SILVER HALIDE PHOTOGRAPHIC MATERIALS

FIELD OF THE INVENTION

This invention relates to a silver halide photographic material, and more particularly to a silver halide photographic material using silver halide emulsions having improved fog and sensitivity properties.

BACKGROUND OF THE INVENTION

Generally, silver halide emulsions used in silver halide photographic materials are chemically sensitized by various chemical substances to obtain desired sensitivity, gradation, etc. Typical examples of conventional sensitization methods include sulfur sensitization, selenium sensitization, noble metal sensitization such as gold sensitization, reduction sensitization and combinations thereof.

Recently, there has been a demand for silver halide photographic materials having high sensitivity, excellent graininess and sharpness. Further, there has been a demand for materials which may be rapidly processed, for example, in an expedited development. Hence, various improvements in the above sensitization methods have been made.

Among the above-described sensitization methods, is the selenium sensitization method disclosed in U.S. Pat. Nos. 1,574,944, 1,602,592, 1,623,499, 3,297,446, 3,297,447, 3,320,069, 3,408,196, 3,408,197, 3,442,653, 3,420,670 and 3,591,385, French Patents 2,093,038 and 2,093,209, JP-B-52-34491 (the term "JP-B" as used herein means an "examined Japanese patent publication"), JP-B-52-34492, JP-B-53-295, JP-B-57-22090, JP-A-59-180536 (the term "JP-A" as used herein means an "unexamined published Japanese patent application"), JP-A-59-185330, JP-A-59-181337, JP-A-59-187338, JP-A-59-192241, JP-A-60-150046, JP-A-60-151637, JP-A-61-246738, U.K. Patents 255,846 and 861,984 and H. E. Spencer, et al., *Journal of Photographic Science,* Vol. 31, pages 158 to 169 (1983).

Generally, selenium sensitization causes great fogging, though selenium sensitization exhibits sensitization efficiency higher than that of sulfur sensitization methods conventionally carried out in the art. Further, selenium sensitization is apt to result in low contrast. Most of the above-described patents are directed to improve these disadvantages. However, sufficient results have not yet been obtained, and there has been a great demand for fundamental improvements in the prevention particularly of fogging.

Further, when sulfur sensitization or selenium sensitization is carried out in combination with gold sensitization, a remarkable increase in sensitivity can be obtained and at the same time, the degree of fogging is increased. Gold-selenium sensitization causes a remarkable rise in fog particularly in comparison to gold-sulfur sensitization. Accordingly, there has been a strong demand for a method for preventing fogging and for a selenium sensitizing agent which scarcely causes fogging.

The above-described patents fail to disclose a method for preventing fog from being caused by selenium compounds described in those patents.

SUMMARY OF THE INVENTION

An object of the present invention is to provide a silver halide photographic material which scarcely causes fogging, but has been highly chemical-sensitized.

Another object of the present invention is to provide a silver halide photographic material with which fog is prevented from being caused.

The above-described objects of the present invention have been achieved by (i) a silver halide photographic material comprising . a support having thereon at least one silver halide emulsion layer, characterized in that at least one silver halide emulsion layer contains at least one compound represented by following general formula (I), (II) or (III); and (ii) a silver halide photographic material containing a silver halide emulsion which has been selenium-sensitized with at least one compound represented by the following general formula (I), (II) or (III):

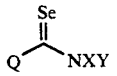

(I)

wherein Q represents an alkyl group, a cycloalkyl group, an alkenyl group, an alkynyl group, an aralkyl group, an aryl group or a heterocyclic group; X represents an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group or a sulfonyl group; Y represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group or a sulfonyl group; and Q and X, X and Y or Y and Q may be combined together to form a ring;

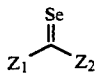

(II)

wherein $Z_1$ represents $—OR_1$, $—SR_2$, $—SeR_3$, or

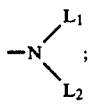

$Z_2$ represents $—OR_4$, $—SR_5$, or $—SeR_6$; $R_1$, $R_2$, $R_3$, $R_4$, $R_5$ and $R_6$ each represents an alkyl group, a cycloalkyl group, an alkenyl group, an alkynyl group, an aralkyl group, an aryl group or a heterocyclic group; $L_1$ and $L_2$ each represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group, a sulfonyl group or an amino group; and $Z_1$ and $Z_2$ or $L_1$ and $L_2$ may be combined together to form a ring;

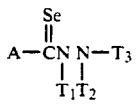

(III)

wherein A represents an alkyl group, a cycloalkyl group, an alkenyl group, an alkynyl group, an aralkyl group, an aryl group, a heterocyclic group, an amino group or a hydrazino group; $T_1$, $T_2$ and $T_3$ each represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group or a sulfonyl group; and any two of A, $T_1$, $T_2$ and $T_3$ may be combined together to form a ring.

DETAILED DESCRIPTION OF THE INVENTION

The compounds of general formula (I) are illustrated in more detail below.

The term Q represents a substituted or unsubstituted alkyl group (e.g., methyl, ethyl, n-butyl, t-butyl, isopropyl, n-octyl), a substituted or unsubstituted cycloalkyl group (e.g., cyclopentyl, cyclohexyl, 2-methylcyclohexyl), a substituted or unsubstituted alkenyl group (e.g., allyl, crotyl, 3-pentenyl), a substituted or unsubstituted alkynyl group (e.g., propargyl, 3-pentynyl), a substituted or unsubstituted aralkyl group (e.g., benzyl, phenethyl), a substituted or unsubstituted aryl group (e.g., phenyl, naphthyl, p-tolyl, mesityl) or a substituted or unsubstituted heterocyclic group (e.g., pyridyl, thienyl, furyl, imidazolyl, piperidyl, morpholinyl).

The examples of a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or un substituted aryl group and a substituted or unsubstituted heterocyclic group represented by X are the same as those set forth in the definition of Q. In addition thereto, X may represent a substituted or unsubstituted acyl group (e.g., acetyl, benzoyl, formyl, pivaloyl, trifluoroacetyl), a substituted or unsubstituted alkoxycarbonyl group (e.g., methoxycarbonyl, ethoxycarbonyl, isopropoxycarbonyl), a substituted or unsubstituted aryloxycarbonyl group (e.g., phenoxycarbonyl, 2-naphthyloxycarbonyl), a substituted or unsubstituted carbamoyl group (e.g., unsubstituted carbamoyl, dimethylcarbamoyl, n-butylcarbamoyl), a substituted or unsubstituted sulfamoyl group (e.g., unsubstituted sulfamoyl, N-ethylsulfamoyl) or a sulfonyl group (e.g., mesyl, tosyl, benzenesulfonyl).

The examples of a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted carbamoyl group, a substituted or unsubstituted sulfamoyl group and a substituted or unsubstituted sulfonyl group represented by Y are the same as those set forth in the definition of X. In addition thereto, Y may represent a hydrogen atom.

Examples of substituent groups on the Q, X and Y groups include an alkyl group (e.g., methyl, ethyl, t-butyl), a cycloalkyl group (e.g., cyclopentyl, cyclohexyl), an alkenyl group (e.g., allyl, 1-propenyl, 3-pentenyl), an alkynyl group (e.g., propargyl, ethynyl), an aralkyl group (e.g., benzyl, phenethyl), an aryl group (e.g., phenyl, naphthyl), a heterocyclic group (e.g., pyridyl, thienyl, furyl, imidazolyl, piperidyl, morpholinyl, benztriazolyl, benzoxazolyl, thiazolyl, tetrazolyl, tetrazaindenyl, indolyl), an acyl group (e.g., acetyl, benzoyl, formyl, pivaloyl), carboxyl group, an alkoxycarbonyl group (e.g., methoxycarbonyl, ethoxycarbonyl, isopropoxycarbonyl), an aryloxycarbonyl group (e.g., phenoxycarbonyl, 2-nathyloxycarbonyl), an acyloxy group (e.g., acetoxy, benzoyloxy, cyclohexylcarbonyloxy), an amino group (e.g., unsubstituted amino, dimethylamino, ethylamino, anilino), an ammonio group (e.g., trimethylammonio), an acylamino group (e.g., acetylamino, benzoylamino), a carbamoyl group (e.g., unsubstituted carbamoyl, n-propylcarbamoyl, dimethylcarbamoyl), a sulfonamido group (e.g., benzenesulfonamido), a sulfamoyl group (e.g., unsubstituted sulfamoyl, N-methylsulfamoyl, N,N-diethylsulfamoyl), an ether group (e.g., methoxy, ethoxy, isopropoxy, phenoxy, 2-naphthyloxy, 2-pyridyloxy), a thioether group (e.g., methylthio, ethylthio, phenylthio), a sulfonyl group (e.g., mesyl, benzenesulfonyl), a sulfinyl group (e.g., methylsulfinyl, ethylsulfinyl), a sulfo group, a sulfino group, a hydroxyl group, a halogen atom (e.g., fluorine chlorine, bromine), a cyano group, a nitro group, a ureido group (e.g., ureido, N'-methylureido), a thioureido group (e.g., thioureido, N'N'-dimethylthioureido), a phosphono group and a mercapto group. These substituent groups may be further substituted.

In general formula (I), Q is preferably a substituted or unsubstituted alkyl group, a substituted or unsubstituted aralkyl group, a substituted or unsubstituted aryl group or a substituted or unsubstituted heterocyclic group; X is preferably a substituted or unsubstituted alkyl group, a substituted or unsubstituted aralkyl or a substituted or unsubstituted aryl group; and Y is preferably a hydrogen atom, a substituted or unsubstituted alkyl group, a substituted or unsubstituted aralkyl group, a substituted or unsubstituted aryl group, a substituted or unsubstituted heterocyclic group, a substituted or unsubstituted acyl group, a substituted or unsubstituted alkoxycarbonyl, a substituted or unsubstituted aryloxycarbonyl group or a substituted or unsubstituted carbamoyl group.

More preferably, Q is a substituted or unsubstituted alkyl group or a substituted or unsubstituted aryl group; X is a substituted or unsubstituted alkyl group or a substituted or unsubstituted aryl group; and Y is a substituted or unsubstituted alkyl group, a substituted or unsubstituted aryl group or a substituted or unsubstituted acyl group.

Most preferably, Q is a substituted or unsubstituted aryl group; and X and Y each is a substituted or unsubstituted alkyl group.

The compounds of general formula (II) are illustrated in more detail below.

$R_1$, $R_2$, $R_3$, $R_4$, $R_5$ and $R_6$ each represents a substituted or unsubstituted alkyl group (e.g., methyl, ethyl, n-propyl, t-butyl, isopropyl, n-octyl), a substituted or unsubstituted cycloalkyl group (e.g., cyclopentyl, cyclohexyl, 2-methylcyclohexyl), a substituted or unsubstituted alkenyl group (e.g., allyl, 2-butenyl, 3-pentenyl), a substituted or unsubstituted alkynyl group (e.g., propargyl, 3-pentynyl), a substituted or unsubstituted aralkyl group (e.g., benzyl, phenethyl), a substituted or unsubstituted aryl group (e.g., phenyl, naphthyl, 4-methylphenyl) or a substituted or unsubstituted heterocyclic group (e.g., pyridyl, thienyl, furyl, imidazolyl, piperidyl, morpholinyl).

Examples of a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, a substituted or unsubstituted carbamoyl group, a substituted or unsubstituted sulfamoyl group and a substituted or unsubstituted sulfonyl group represented by $L_1$ and $L_2$ are the same as those set forth in the definition of X in general formula (I). In addition thereto, $L_1$ and $L_2$ may each represent a substituted or unsubstituted amino group (e.g., unsubstituted amino, ethylamino, dimethylamino, t-butylamino, n-amylamino, anilino, p-anisidino, diphenylamino).

Examples of substituent groups on the $R_1$, $R_2$, $R_4$, $R_5$, $R_6$, $L_1$ and $L_2$ groups include those already described above in the definition of the substituent groups on the Q, X and Y groups in general formula (I).

In general formula (II), $Z_1$ is preferably $-OR_1$, $-SR_2$ or

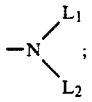

and $Z_2$ is preferably $-OR_4$ or $-SR_5$.

In these cases, $R_1$, $R_2$, $R_4$ and $R_5$ each represents a substituted or unsubstituted alkyl group, a substituted or unsubstituted aralkyl group, a substituted or unsubstituted aryl group or a substituted or unsubstituted heterocyclic group; and $L_1$ and $L_2$ each represents a hydrogen atom, a substituted or unsubstituted alkyl group, a substituted or unsubstituted aralkyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group or a substituted or unsubstituted carbamoyl group.

In general formula (II), more preferably, $Z_1$ is

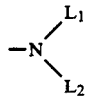

and $Z_2$ is $-OR_4$ or $-SR_5$ wherein $R_4$ and $R_5$ each is a substituted or unsubstituted alkyl group or a substituted or unsubstituted aryl group, and $L_1$ and $L_2$ each is an alkyl group which may be substituted, an aryl group which may be substituted or an acyl group which may be substituted.

The compounds of general formula (III) are illustrated in more detail below.

The term A represents a substituted or unsubstituted alkyl group (e.g., methyl, ethyl, n-butyl, t-butyl, isopropyl, n-octyl), a substituted or unsubstituted cycloalkyl group (e.g., cyclopentyl, cyclohexyl, 2-methylcyclohexyl), a substituted or unsubstituted alkenyl group (e.g., allyl, 2-crotyl, 3-pentenyl), a substituted or unsubstituted alkynyl group (e.g., propargyl, 3-pentynyl), a substituted or unsubstituted aralkyl group (e.g., benzyl, phenethyl), a substituted or unsubstituted aryl group (e.g., phenyl, naphthyl, p-tolyl, mesityl), a substituted or unsubstituted heterocyclic group (e.g., pyridyl, thienyl, furyl, imidazolyl, piperidyl, morpholinyl), a substituted or unsubstituted amino group (e.g., unsubstituted amino, methylamino, diethylamino, t-butylamino, n-amylamino, anilino, p-anisidino, diphenylamino) or a substituted or unsubstituted hydrazino group (e.g., unsubstituted hydrazino, 1,1,2-trimethylhydrazino).

The examples of a substituted or unsubstituted alkyl group, a substituted or unsubstituted cycloalkyl group, a substituted or unsubstituted alkenyl group, a substituted or unsubstituted alkynyl group, a substituted or unsubstituted aralkyl group, a substituted or unsubstituted aryl group and a substituted or unsubstituted heterocyclic group represented by $T_1$, $T_2$ and $T_3$ are the same as those set forth in the definition of A. In addition thereto, $T_1$, $T_2$ and $T_3$ may each represent a substituted or unsubstituted acyl group (e.g., acetyl, benzoyl, formyl, pivaloyl, trifluoroacetyl), a substituted or unsubstituted alkoxycarbonyl group (e.g., methoxycarbonyl, ethoxycarbonyl, isopropoxycarbonyl), a substituted or unsubstituted aryloxycarbonyl group (e.g., phenoxycarbonyl, 2-naphthyloxycarbonyl), a substituted or unsubstituted carbamoyl group (e.g., unsubstituted carbamoyl, dimethylcarbamoyl, n-butylcarbamoyl), a substituted or unsubstituted sulfamoyl group (e.g., sulfamoyl, N-ethylsulfamoyl) or a substituted or unsubstituted sulfonyl group (e.g., mesyl, tosyl, benzenesulfonyl).

Examples of the substituent groups on the A, $T_1$, $T_2$ and $T_3$ groups include those already described above in the definition of the substituent groups on the Q, X and Y groups in general formula (I).

In general formula (III), A is preferably a substituted or unsubstituted alkyl group, a substituted or unsubstituted aralkyl group, a substituted or unsubstituted aryl group, a substituted or unsubstituted heterocyclic group or a substituted or unsubstituted amino group; and $T_1$, $T_2$ and $T_3$ are preferably each a hydrogen atom, a substituted or unsubstituted alkyl group, a substituted unsubstituted aralkyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group or a substituted or unsubstituted carbamoyl group.

Examples of the compounds in the photographic material of the present invention include, but are not limited to, the following:

$$CH_3\overset{\overset{Se}{\|}}{C}NHCH_3 \qquad \text{I-1}$$

$$CH_3CH(CH_3)CH_2\overset{\overset{Se}{\|}}{C}NHCH_3 \qquad \text{I-2}$$

-continued

I-3

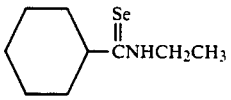

I-4

$CH_3CH_2CH_2\overset{Se}{\overset{\|}{C}}N(CH_3)_2$

I-5

$CH_2{=}CHCH_2\overset{Se}{\overset{\|}{C}}N(C_2H_5)_2$

I-6

$CH{\equiv}CCH_2\overset{Se}{\overset{\|}{C}}N(CH_3)_2$

I-7

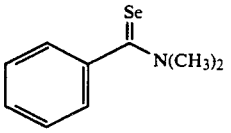

I-8

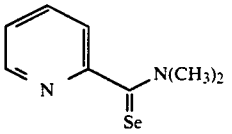

I-9

$CH_3\overset{Se}{\overset{\|}{C}}N(CH_3)(C_6H_5)$

I-10

$C_6H_5CH_2\overset{Se}{\overset{\|}{C}}NHCH_3$

I-11

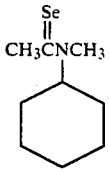

I-12

$CH_3\overset{Se}{\overset{\|}{C}}NHCH_2CH{=}CH_2$

I-13

$CH_3\overset{Se}{\overset{\|}{C}}NHCH_2CHC{\equiv}CH_2$

I-14

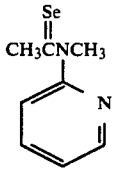

I-15

$CH_3\overset{Se}{\overset{\|}{C}}N(CH_3)COCH_3$

I-16

$C_6H_5\overset{Se}{\overset{\|}{C}}N(CH_3)COCF_3$

-continued

I-17

$C_6H_5\overset{Se}{\overset{\|}{C}}N(CH_3)CO_2CH_3$

I-18

$C_6H_5\overset{Se}{\overset{\|}{C}}N(CH_3)CONCH_2$

I-19

$C_6H_5\overset{Se}{\overset{\|}{C}}N(CH_3)SO_2CH_3$

I-20

$C_6H_5CH_2\overset{Se}{\overset{\|}{C}}N(CH_3)COCH_2CN$

I-21

$C_6H_5\overset{Se}{\overset{\|}{C}}N(C_6H_5)_2$

I-22

$CH_3\overset{Se}{\overset{\|}{C}}N(CH_3)CH_2CH_2COOH$

I-23

$CH_3\overset{Se}{\overset{\|}{C}}N(CH_3)CH_2CH_2OH$

I-24

$CH_3\overset{Se}{\overset{\|}{C}}N(CH_3)CH_2CH_2SO_3Na$

I-25

$C_6H_5\overset{Se}{\overset{\|}{C}}N(CH_3)CH_2CH_2N(CH_3)_2$

I-26

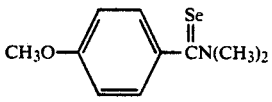

I-27

$C_6H_5\overset{Se}{\overset{\|}{C}}N(CH_3)CH_2CH_2SCH_2CH_2OH$

I-28

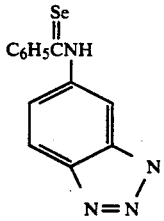

I-29

$C_6H_5\overset{Se}{\overset{\|}{C}}NHCH_2CH_2NHCSN(CH_3)_2$

I-30

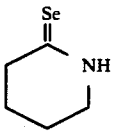

-continued
I-31
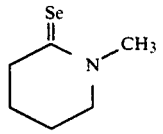
I-32
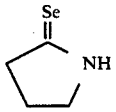
I-33
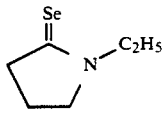
I-34
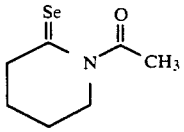
I-35
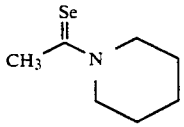
I-36
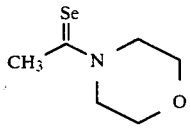
I-37
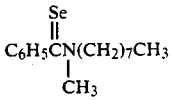
I-38
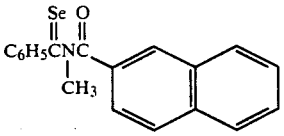
I-39
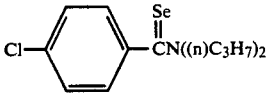
I-40
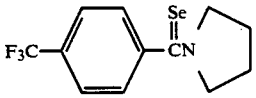
I-41
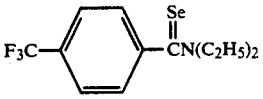
I-42
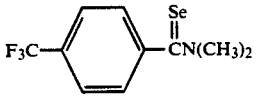
-continued
I-43
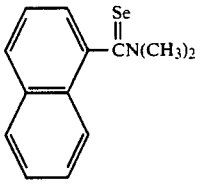
I-44
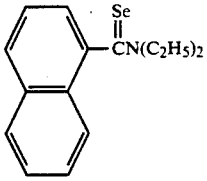
I-45
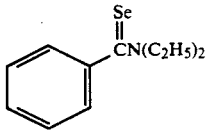
I-46
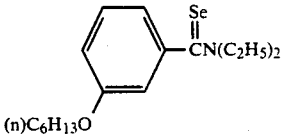
I-47
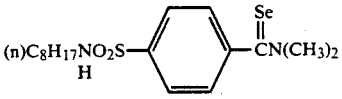
I-48
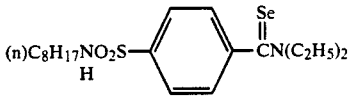
I-49
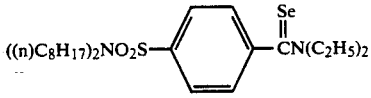
II-1
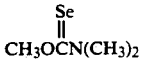
II-2
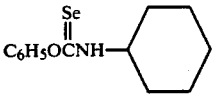
II-3
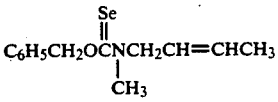
II-4
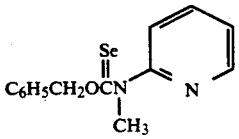
II-5
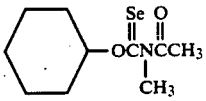

-continued
II-6
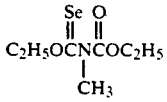
II-7
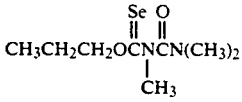
II-8
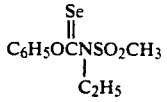
II-9
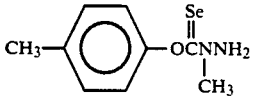
II-10
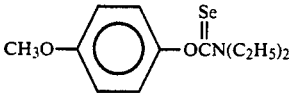
II-11
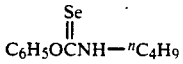
II-12
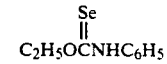
II-13
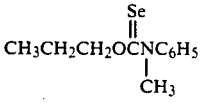
II-14
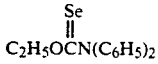
II-15
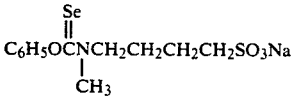
II-16
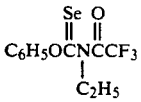
II-17
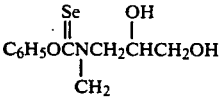
II-18
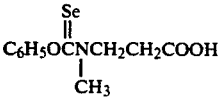
II-19
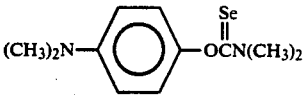
II-20
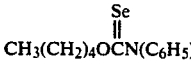
II-21
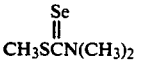
-continued
II-22
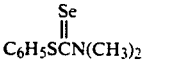
II-23
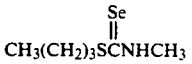
II-24
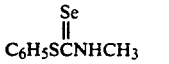
II-25
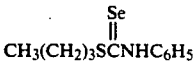
II-26
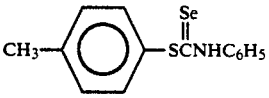
II-27
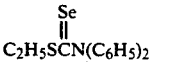
II-28
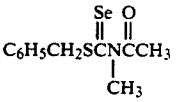
II-29
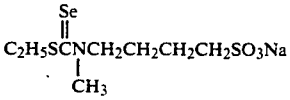
II-30
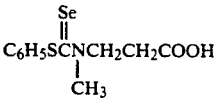
II-31
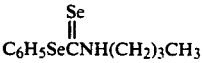
II-32
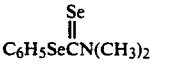
II-33
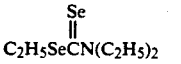
II-34
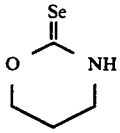
II-35
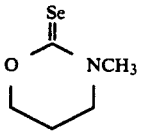
II-36
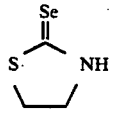
II-37
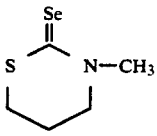

-continued

II-38

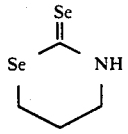

II-39

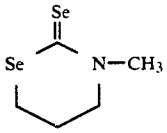

II-40

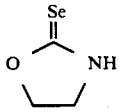

II-41 $C_2H_5OC(=Se)OC_2H_5$

II-42 $C_6H_5OC(=Se)OC_2H_5$

II-43 $C_6H_5SC(=Se)OC_2H_5$

II-44 $CH_3(CH_2)_2SC(=Se)S(CH_2)_3CH_3$

II-45 $C_2H_5SeC(=Se)SeC_2H_5$

II-46

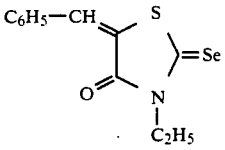

II-47

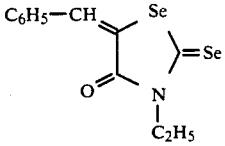

II-48

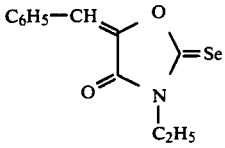

II-49

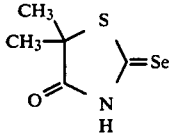

II-50

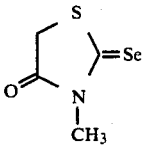

-continued

III-1 $C_2H_5C(=Se)NHNHC_2H_5$

III-2 $CH_3CH(CH_3)CH_2C(=Se)N(CH_3)_2$

III-3 $(CH_3)_2NC(=Se)N(CH_3)_2$ ($CH_3$)

III-4 $C_2H_5NHC(=Se)N(CH_3)_2$ ($CH_3$)

III-5 $(CH_3)_2NC(=Se)NHN(CH_3)_2$

III-6 $(CH_3)_2NC(=Se)NHCH_3$ ($CH_3$)

III-7 $(CH_3)_2NC(=Se)NHNHCH_3$

III-8 $(CH_3)_2NC(=Se)NH_2$ ($CH_3$)

III-9 $H_2NC(=Se)N(CH_3)_2$ ($CH_3$)

III-10 $C_2H_5NHC(=Se)NHCH_3$ ($CH_3$)

III-11 $C_2H_5NHC(=Se)NHN(CH_3)_2$

III-12 $H_2NC(=Se)NHN(CH_3)_2$

III-13 $H_2NC(=Se)NHCH_3$ ($CH_3$)

III-14 $CH_3NHC(=Se)NH_2$ ($CH_3$)

III-15 $CH_3NHC(=Se)NHNHCH_3$

III-16 $(C_2H_5)_2NC(=Se)NHNH_2$

III-17 $n\text{-}C_4H_9NHC(=Se)NHNH_2$

-continued

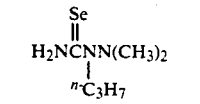
III-18

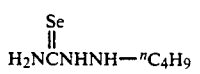
III-19

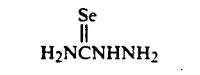
III-20

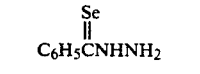
III-21

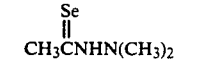
III-22

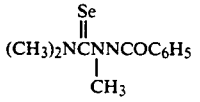
III-23

The compounds represented by general formulas (I), (II) and (III) can be synthesized according to known methods such as those described in Saul Patai, *The Chemistry of Organic Selenium and Tellurium Compounds,* Vol 2, pp 247–258 (1987), *Journal of the Chemical Society,* Chemical Communication, pp. 1494–1496 (1988), etc.

The synthesis method of the compound according to the present invention is explained below, with giving a representative example thereof.

SYNTHESIS EXAMPLE 1

Synthesis of Compound I-41 (N,N-diethyl-4-trifluoromethylselenobenzamide)

To 23.3 g of phenyldichlorophosphine was added 12.3 g of selenium powder under nitrogen atmosphere and the mixture was stirred at 170° C. for 1 hour. The reaction solution was cooled to room temperature and then unreacted selenium was separated by filtration. To the filtrate was dropwise added 35 ml of toluene solution of 12.4 g of N,N-diethyl-4-trifluoromethylbenzamide and the mixture was stirred at 100° C. for 4 hours. After the reaction solution was cooled to room temperature, 500 ml of mixed solvent of dichloromethane and hexane (1:5) was added thereto, further 500 g of alumina (70 to 230 mesh) was added thereto and then they were mixed. Twenty minutes after the completion of the mixture, the mixture was supported on an alumina column packed with 800 g of alumina (70 to 230 mesh). The elution with mixed solvent of dichloromethane and hexane (1:4) was conducted and then the resulting eluate was distilled under reduced pressure to obtain a crystal. The crystal was recrystallized from 60 ml of ethanol to obtain 6.0 g of a yellow crystal of desired compound I-41. The crystal was confirmed to be the desired compound according to NMR spectrum, mass spectrum and elemental analysis. Yield: 38%. Melting point: 66° to 67° C.

The concrete use of the compounds of general formulas (I), (II) and (III) as anti-fogging agents or selenium sensitizing agents is novel. Accordingly, it would be difficult for those in the art to expect that those compounds would have a sensitizing effect, an anti-fogging effect and other photographic effects. However, remarkable effects could be unexpectedly obtained by the compounds of the present invention.

The amount of the selenium compound in the material of the present invention vary depending on the type of selenium compound to be used, the type of silver halide grain, the chemical ripening conditions, etc. But it is generally $10^{-8}$ to $10^{-4}$ mol, preferably $10^{-7}$ to $10^{-5}$ mol, per mol of silver halide when the compounds are used as selenium sensitizing agents. When the compounds are used as antifogging agents, the amount thereof is generally $10^{-7}$ to $10^{-2}$ mol, preferably $10^{-6}$ to $10^{-3}$ mol, per mol of silver halide.

The chemical sensitization conditions of the present invention are such that pAg is in the range of 6 to 11, preferably 7 to 10, more preferably 7 to 9.5, and the temperature is 40° to 95° C., preferably 50° to 85° C., though there is no particular limitation to either condition.

In the present invention, it is preferred to use a noble metal sensitizing agent such as a gold, platinum, palladium or iridium compound, particularly a gold sensitizing agent, together with the compounds of present invention. Concrete examples of the gold sensitizing agent include chloroauric acid, potassium chloroaurate, potassium aurithiocyanate, gold sulfide and gold selenide. These gold sensitizing agents are used in an amount of $10^{-7}$ to $10^{-2}$ mol per mol of silver halide.

It is preferred to use also a sulfur sensitizing agent together with noble metal sensitizing agent. Concretely, examples of the sulfur sensitizing agent include conventional unstable sulfur compounds such as thiosulfates (e.g., hypo), thioureas (e.g., diphenylthiourea, triethylthiourea, allylthiourea, etc.) and rhodanine compounds. These compounds are used in an amount of about $10^{-7}$ to $10^{-2}$ mol per mol of silver halide.

In the present invention, it is possible to use also a reduction sensitizing agent together with the above agents. Examples of the reduction sensitizing agent include stannous chloride, aminoiminomethanesulfinic acid, hydrazine derivatives, borane compounds, silane compounds and polyamine compounds.

It is preferred that selenium sensitization is carried out in the presence of solvents for silver halide.

Examples of the solvents for silver halide include thiocyanates (e.g., potassium thiocyanate), thioether compounds (e.g., compounds, particularly 3,6-dithia-1,8-octanediol, described in U.S. Pat. Nos. 3,021,215 and 3,271,157, JP-B-58-30571, JP-A-60-136736, etc.), tetra-substituted thiourea compounds (e.g., compounds, particularly tetramethylthiourea, described in JP-B 59-11892, U.S. Pat. No. 4,221,863, etc.), thione compounds described in JP-B-60-11341, mercapto compounds described in JP-B-63-29727, meso-ionic compounds described in JP-A-60-163042, seleno-ether compounds described in U.S. Pat. No. 4,782,013, telluroether compounds described in Japanese Patent Application No. 63-173474 (corresponding to JP-A-2-118566) and sulfites. Among them, the preferable solvents are thiocyanates, thioether compounds, tetra-substituted thiourea compounds and thione compounds. These compounds are used in an amount of $10^{-5}$ to $5\times10^{-2}$ mol per mol of silver halide.

Preferred silver halides used in the silver halide emulsions of present invention are silver bromide, silver iodobromide, silver iodochlorobromide, silver chlorobromide and silver chloride.

Silver halide grains used in the present invention may have a regular crystal form such as a cube or octahedron, an irregular crystal form such as a sphere or platy form or a composite form of these crystal forms. A mixture of grains having various crystal forms can be used. However, it is preferred that grains having a regular crystal form are used.

Silver halide grains used in the present invention may be composed of grains wherein the interior of the grain and the surface layer thereof are different in phase from each other, or the grains may be composed of a uniform phase. Grains may be used wherein a latent image is predominantly formed on the surface of the grain (e.g., negative type emulsion) or grains wherein a latent image is predominantly formed in the interior of the grain (e.g., internal latent image type emulsion, previously fogged direct reversal type emulsion). However, grains wherein a latent image is predominantly formed on the surface of the grain are preferable.

Preferred examples of the silver halide emulsions of the present invention include tabular grain emulsions wherein grains having a thickness of not more than 0.5 μm, preferably not more than 0.3 μm, a diameter of preferably not smaller than 0.6 μm and an aspect ratio of not lower than 5 account for at least 50% of the entire projected area of the entire grains, and monodisperse emulsions having a coefficient of variation (a value S/d obtained by dividing a standard deviation S by a diameter d in a grain size distribution when the diameter of the grain is represented by a diameter of a circle having an area approximately equal to the projected area of the grain) of not higher than 20% statistically. A mixture of one or more tabular grain emulsions and one or more monodisperse emulsions may be used.

Photographic emulsions which are used in the present invention can be prepared according to the methods described in P. Glafkides, *Chimie et Physique Photoqrapheque* (Paul Montel 1967), G. F. Duffin, *Photographic Emulsion Chemistry* (Focal Press 1966) and V. L. Zelikman et al, *Making and Coating Photographic Emulsion* (Focal Press 1964)

Solvents for silver halide can be used during the formation of silver halide grains to control the growth of grains. Examples of such solvents for silver halide include ammonia, potassium rhodanide, ammonium thiocyanate, thioether compounds (e.g., compounds described in U.S. Pat. Nos. 3,271,157, 3,574,628, 3,704,130, 4,297,439 and 4,276,374), thione compounds (e.g., compounds described in JP-A-53-144319, JP-A-53-2408, JP-A-55-77737, etc.) and amine compounds (e.g., compounds described in JP-A-54-100717, etc.).

Cadmium salt, zinc salt, thallium salt, iridium salt or a complex salt thereof, rhodium salt or a complex salt thereof, or iron salt or a complex salt thereof may coexist during the formation of silver halide grains or during the physical ripening thereof.

Gelatin can be advantageously used as a binder or protective colloid which can be used in the emulsion layers and interlayers of the photographic materials of the present invention. In addition thereto other hydrophilic colloids can be used. For example, there can be used protein such as gelatin derivatives, graft polymers of gelatin with other high-molecular materials, albumin and casein, cellulose derivatives such as hydroxyethyl cellulose, carboxymethyl cellulose and cellulose sulfate, sodium alginate, saccharose derivatives such as starc derivatives and synthetic hydrophilic high-molecular materials such as homopolymer, for example, polyvinyl alcohol, polyvinyl alcohol partial acetal, poly-N-vinyl pyrrolidone, polyacrylic acid, polymethacrylic acid, polyacrylamide, polyvinyl imidazole and polyvinyl pyrazole and copolymers thereof.

Examples of gelatin which can be used include general-purpose lime-processed gelatin, acid-processed gelatin, enzyme-processed gelatin [as described in Bull. Soc. Sci. Phot. Japan, No. 16, Page 30 (1966)] and hydrolyzate of gelatin.

Hydrophilic colloid layers which form the photographic light-sensitive layers or back layers of the photographic materials of the present invention may contain inorganic or organic hardening agents. Examples of the hardening agents include chromium salts, aldehydes (e.g., formaldehyde, glyoxal, glutaraldehyde) and N-methylol compounds (e.g., dimethylol urea). Active halogen compounds (e.g., 2,4-dichloro-6-hydroxy1,3,5-triazine and sodium salt thereof) and active vinyl compounds (e.g., 1,3-bisvinylsulfonyl-2-propanol, 1,2-bis(-vinylsulfonylacetamido) ethane, bis(vinylsulfonylmethyl) ether or vinyl polymers having vinylsulfonyl group on side chain) are preferred, because hydrophilic colloid such as gelatin can be rapidly hardened and stable photographic characteristics can be imparted to it. Further, N-carbamoylpyridinium salts [e.g., (1-morpholinocarbonyl-3-pyridinio)methanesulfonate] and haloamidinium salts [e.g., 1-(1-chloro-1-pyridinomethylene) pyrrolidinium 2-naphthalenesulfonate] are superior, because their curing rate is rapid.

Silver halide photographic emulsions used in the present invention may be spectral-sensitized by methine dyes, etc. Examples of dyes which can be used include cyanine dyes, merocyanine dyes, complex cyanine dyes, complex merocyanine dyes, holopolar cyanine dyes, hemicyanine dyes, styryl dyes and hemioxonol dyes. Particularly useful dyes are those belonging to the cyanine dyes, merocyanine dyes and complex merocyanine dyes groups.

Any of the nuclei conventionally used for cyanine dyes such as basic heterocyclic ring nuclei can be applied to these dyes. Examples of the nuclei which can be applied to these dyes include a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, and the nuclei formed by fusing alicyclic hydrocarbon rings to the above-mentioned nuclei and nuclei formed by fusing aromatic hydrocarbon rings to the above-mentioned nuclei such as an indolenine nucleus, a benzindolenine nucleus, an indole nucleus, a benzoxazole nucleus, a naphthoxazole nucleus, a benzthiazole nucleus, a naphthothiazole nucleus, a benzoselenazole nucleus, a benzimidazole nucleus and a quinoline nucleus. These nuclei may optionally have one or more substituent groups on carbon atoms.

Five-membered to six-membered heterocyclic ring nuclei such as a pyrazoline-5-one nucleus, a thiohydantoin nucleus, a 2-thio-oxazolidine-2-dione nucleus, a thiazolidine-2,4-dione nucleus, a rhodanine nucleus and a thiobarbituric acid nucleus are nuclei having a ketomethylene structure which can be applied to merocyanine dyes and complex merocyanine dyes.

These sensitizing dyes may be used either alone or in combination. A combination of sensitizing dyes is often used for the purpose of supersensitization in particular. Emulsion may contain a dye which itself does not have a spectral sensitization effect, but has a supersensitization effect or a substance which substantially does not absorb visible light, but has a supersensitization effect, in combination with a sensitizing dye. For example, the emulsions may contain nitrogen-containing heterocyclic ring nucleus group-substituted aminostilbene compounds (e.g., compounds described in U.S. Pat. Nos. 2,933,390 and 3,635,721), aromatic organic acid-formaldehyde condensates (e.g., compounds described in U.S. Pat. No. 3,743,510), cadmium salts and azaindene compounds. Combinations described in U.S. Pat. Nos. 3,615,613, 3,615,641, 3,617,296 and 3,635,721 are particularly useful.

The silver halide photographic emulsions of the present invention may contain various compounds to prevent fogging from occurring during the preparation or storage of the photographic materials or during processing or to stabilize photographic performance. Examples of such compounds, known as anti-fogging agents or stabilizers, include azoles such as benzthiazolium salts, nitroimidazoles, nitrobenzimidazoles, chlorobenzimidazoles, bromobenzimidazoles, mercaptothiazoles, mercaptobenzthiazoles, mercaptobenzimidazoles, mercaptothiadiazoles, aminotriazoles, benztriazoles, nitrobenztriazoles and mercaptotetrazoles (particularly 1-phenyl5-mercaptotetrazole); mercaptopyrimidines; mercaptotriazines; thioketo compounds such as oxazoline thione; azaindenes such as triazaindenes, tetraazaindenes (particularly 4-hydroxy-substituted (1,3,3a,7)-tetraazaindenes) and pentaazaindenes; and benzene derivatives such as benzenethio sulfinic acid, benzenesulfinic acid and benzenesulfonamide.

The photographic materials of the present invention may contain one or more surfactants as a coating aid or to impart antistatic properties or to improve slipperiness, emulsifying dispersion and photographic characteristics (e.g., development acceleration, high contrast, sensitization) or to prevent sticking from being caused.

The hydrophilic colloid layers of the photographic materials of the present invention may contain water-soluble dyes as filter dyes or to prevent irradiation or halation. Preferred examples of such dyes include oxonol dyes, hemioxonol dyes, styryl dyes, merocyanine dyes, anthraquinone dyes and azo dyes. In addition thereto, cyanine dyes, azomethine dyes, triarylmethane dyes and phthalocyanine dyes are useful. Oil-soluble dyes can be emulsified by oil-in-water dispersion methods and then added to the hydrophilic colloid layers.

The present invention can be applied to multi-layer multi-color photographic materials having at least two different spectral sensitivities provided on supports. A multi-layer natural color photographic material generally comprises a support having thereon at least one red-sensitive emulsion layer, at least one green sensitive emulsion layer and at least one blue-sensitive emulsion layer. The order of the arrangement of these layers can be selected as is desired. Preferably, the arrangement is made in the order of the red sensitive layer, the green-sensitive layer and blue-sensitive layer, in the order of the blue-sensitive layer, the green-sensitive layer and the red-sensitive layer or in the order of the blue-sensitive layer, the red-sensitive layer and the green-sensitive layer from the side facing the support.

If desired, the emulsion layer may be composed of two or more emulsion layers having the same color sensitivity, but different sensitivities to improve attainable sensitivity. Further, the emulsion layer may be composed of a three-layer structure to improve graininess. A light-insensitive layer may be interposed between two or more emulsion layers having the same color sensitivity. Furthermore, between emulsion layers having the same color sensitivity there may be provided an emulsion layer having different color sensitivities. A reflection layer comprising fine silver halide grains may be provided under a high-sensitivity layer, particularly high-sensitivity blue-sensitive layer to improve sensitivity.

Generally, the red-sensitive emulsion layer contains a cyan color-forming coupler, the green-sensitive emulsion layer contains a magenta color-forming coupler and the blue-sensitive emulsion layer contains a yellow color-containing coupler. If desired, different combinations may be made. For example, an infrared-sensitive layer may be combined to form emulsion layers for a pseudo-color photograph or exposure to a semiconductor laser.

The photographic materials of the present invention may contain various color couplers. Concrete examples of the color couplers are described in the patent specifications cited in the aforesaid *Research Disclosure* (RD) No. 17643, VII-C to G, (December 1978).

Examples of yellow couplers which can be preferably used include compounds described in U.S. Pat. Nos. 3,933,501, 4,022,620, 4,326,024 and 4,401,752, JP-B-58-10739, U.K. Patents 1,425,020 and 1,476,760.

Preferred magenta couplers include 5-pyrazolone compounds and pyrazoloazole compounds. Examples of magenta couplers which can be preferably used include compounds described in U.S. Pat. Nos. 4,310,618 and 4,351,897, European Patent 73,636, U.S. Pat. Nos. 3,061, 432 and 3,725,067, *Research Disclosure* No. 24220 (June 1984), JP-A-60-33552, *Research Disclosure* No. 24230 (June 1984), JP-A-60-43659, U.S. Pat. Nos. 4,500,630 and 4,540,654.

Cyan couplers include phenol couplers and naphthol couplers. Examples of the cyan couplers which can be preferably used include the compounds described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid-open No. 3,329,792, European Patent 121,365A, U.S. Pat. Nos. 3,446,622, 4,333,999, 4,451,559 and 4,427,767 and European Patent 161,626A.

Preferred examples of the colored couplers for correcting unnecessary absorption of developed dyes include those described in *Research Disclosure* No. 17643, item VII-G (December 1978), U.S. Pat. No. 4,163,670, JP-B-57-39413, U.S. Pat. Nos. 4,004,929 and 4,138,258 and U.K. patent 1,146,368.

Preferred examples of couplers in which developed dyes are properly diffusing include the compounds described in U.S. Pat. No. 4,366,237, U.K. Patent 2,125,570, European Patent 96,570, and West German Patent (Laid-open) 3,234,533.

Typical examples of dye-forming polymer couplers are described in U.S. Pat. Nos. 3,451,820, 4,080,211 and 4,367,282 and U.K. Patent 2,102,173.

Couplers which release a photographically useful residue upon coupling can be preferably used in the present invention. Preferred examples of DIR couplers which release a development inhibitor include the compounds described in patent specifications cited in the aforesaid RD 17643, item VII-F (December 1978), JP-A-57-151944, JP-A-57-154234, JP-A-60-184248 and U.S. Pat. No. 4,248,962.

Preferred examples of couplers which release imagewise a nucleating agent or a development accelerator during development include compounds described in U.K. Patents 2,097,140 and 2,131,188, JP-A-59-157638 and JP-A-50-170840.

Examples of other couplers which can be used in the photographic materials of the present invention include the competitive couplers described in U.S. Pat. No. 4,130,427; polyequivalent type couplers described in U.S. Pat. Nos. 4,283,472, 4,338,393 and 4,310,618; DIR redox compound or DIR coupler-releasing couplers described in JP-A-60-185950 and JP-A-62-24252; couplers which release a dye which is restored to the original color after elimination as described in European Patent 173,302A; bleaching accelerator-releasing couplers described in RD No. 11449 (October 1973), RD No. 24241 (June 1984), JP-A-61-201247; and ligand-releasing couplers described in U.S. Pat. No. 4,553,477.

The couplers which are used in the present invention can be introduced into the photographic materials by various known dispersion methods.

Examples of high-boiling solvents which are used in oil-in-water dispersion method are described in U.S. Pat. No. 2,322,027, etc.

Concrete examples of high-boiling organic solvents having a boiling point of not lower than 175° C. under atmospheric pressure which are used in oil-in-water dispersion methods include phthalic esters (e.g., dibutyl phthalate, dicyclohexyl phthalate, di-2-ethylhexyl phthalate, decyl phthalate, bis(2,4-di-t-amylphenyl) phthalate, bis(2,4-di-t-amylphenyl) isophthalate, bis(1,1-diethylpropyl) phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-2-ethylhexyl phenyl phosphate), benzoic esters (e.g., 2-ethylhexyl benzoate, dodecyl benzoate, 2-ethylhexyl p-hydroxybenzoate), amides (e.g., N,N-diethyldodecaneamide, N,N-diethyllaurylamide, N-tetradecylpyrrolidone), alcohols and phenols (e.g., isostearyl alcohol, 2,4-di-tert-amylphenol), aliphatic carboxylic acid esters (e.g., bis(2-ethylhexyl) sebacate, dioctyl azelate, glycerol tributyrate, isostearyl lactate, trioctyl citrate), aniline derivatives (e.g., N,N-dibutyl 2-butoxy-5-tert-octylaniline) and hydrocarbons (e.g., paraffin, dodecylbenzene, diisopropylnaphthalene). Organic solvents having a boiling point of not lower than about 30° C., preferably not lower than 50° C., but not higher than about 160° C., can be used as co-solvents. Typical examples of the co-solvents include ethyl acetate, butyl acetate, ethyl propionate, methyl ethyl ketone, cyclohexanone, 2-ethoxyethyl acetate and dimethylformamide.

The stages and effects of latex dispersion methods and examples of impregnating latexes are described in U.S. Pat. No. 4,199,363 and West German Patent Application (OLS) Nos. 2,541,274 and 2,541,230.

The photographic emulsion layers and other layers of the photographic materials of the present invention are coated on flexible supports such as plastic film, paper and cloth or rigid supports such as glass, earthenware and metals. Those supports are conventionally used for photographic materials. Examples of useful flexible supports include films composed of a semisynthetic or synthetic high-molecular material such as cellulose nitrate, cellulose acetate, cellulose acetate butyrate, polystyrene, polyvinyl chloride, polyethylene terephthalate or polycarbonate and paper coated or laminated with barayta layer or an α-olefin polymer (e.g., polyethylene, polypropylene, an ethylene/butene copolymer). The supports may be colored with dyes or pigments. The supports may be blackened to screen light. The surfaces of these supports are generally subjected to subbing treatment to improve adhesion to photographic emulsion layers, etc. The surfaces of the supports may be subjected to glow discharge treatment, corona discharge treatment, ultraviolet light irradiation or flame treatment before or after subbing treatment.

The photographic emulsion layers and other hydrophilic colloid layers can be coated by conventional coating methods such as dip coating, roller coating, curtain coating and extrusion coating. If desired, multi layers may be simultaneously coated by the coating methods described in U.S. Pat. Nos. 2,681,294, 2,761,791, 3,526,528 and 3,508,947.

The present invention can be applied to various color photographic materials and black-and-white photographic materials. Typical examples of the photographic materials to which the present invention is applicable include general-purpose and movie color negative films, reversal color films for slide and TV, color paper, color positive films, reversal color paper, diffusion transfer type color photographic materials and heat developable color photographic materials. The present invention can also be applied to X-ray black-and-white photographic materials, etc. by utilizing the tricolor coupler mixing described in *Research Disclosure* No. 17123 (July 1978) or the black color-forming couplers described in U.S. Pat. No. 4,126,461 and U.K. Patent 2,102,136. Further, the present invention is applicable to films for plate making such as lith films or scanner films, X-ray films for direct or indirect medical or industrial use, negative black-and-white films for photographing, black-and-white photographic paper, microfilms for COM or general purpose, silver salt diffusion transfer type photographic materials and print-out type photographic materials.

When the photographic elements of the present invention are applied to color diffusion transfer photography, a peel apart type, an integrated type (as described in JP-B 46-16356, JP-B-48-33697, JP-A-50-13040 or U.K. Patent 1,330,524) or a film unit type (peeling being not required as described in JP-A-57-119345) may be used.

It is advantageous from the viewpoint of widening the range of the applicable processing temperature that a polymer acid layer protected by a neutralization timing layer is used in any format of the above-described types. When the polymer acid layer is applied to color diffusion transfer photography, the polymer acid may be added to any layer in the photographic material or the polymer acid may be contained as a developer component in a container for processing solution.

The photographic materials can be exposed by using various exposure means. Arbitrary light sources which emit radiations corresponding to the sensitive wavelengths of the photographic materials can be used as illumination light sources or writing light sources.

Generally, natural light (sunlight), incandescent lamp, halogen lamp, mercury vapor lamp, fluorescent lamp and flash light sources such as strobe and metal-burning flash valve are used. Gas, dye solution or semiconductor laser which emit light in the wavelength region of ultraviolet light to infrared rays, light-emitting diode and plasma light source can be used as the recording light source. Further, one can use fluorescent screen (CRT, etc.) released from a phosphor excited with electron beam, etc., and exposure means composed of a combination of linear or planar light source with a microshutter array which utilizes liquid crystal (LCD) or lead titano-zirconate doped with lanthanum (PLZT). If desired, spectral distribution used for exposure can be adjusted by color filters.

The color developing solutions which can be used in the present invention are preferably aqueous alkaline solutions mainly composed of aromatic primary amine color developing agents. Aminophenol compounds are useful as the color developing agents and p-phenylenediamine compounds are preferred as the color developing agents. Typical examples thereof include 3μmethyl 4-amino-N,N-diethylaniline, 3-methyl-4-amino-N-ethyl-N-β-hydroxymethylaniline, 3-methyl-4-amino-N-ethyl-N-β-methanesulfonamidoethylaniline, 3-methyl-4-amino-N-ethyl-N-β-methoxyethylaniline and salts thereof such as sulfate, hydrochloride and p-toluenesulfonate. Generally, these diamines in the form of a salt are more stable than those in the free form and hence they are preferably used in the form of a salt.

Generally, the color developing solutions contain pH buffering agents such as alkali metal carbonates, borates and phosphates, development inhibitors such as bromides, iodides, benzimidazoles, benzothiazoles and mercapto compounds and anti-fogging agents. If desired, the color developing solutions may optionally contain preservatives such as hydroxylamine, and sulfites; organic solvents such as triethanolamine and diethylene glycol;- development accelerators such as benzyl alcohol, polyethylene glycol, quaternary ammonium salts and amines; color forming couplers, competitive couplers, nucleating agents such as sodium boron hydride; auxiliary developing agents such as 1-phenyl-3-pyrazolidone; tackifiers; and chelating agents such as aminopolycarboxylic acids, aminopolyphosphonic acids, alkylphosphonic acids and phosphonocarboxylic acids and antioxidants described in West German Patent Application (OLS) No. 2,622,950.

Generally, when development processing for reversal color photographic material is to be conducted, black-and-white development is first carried out and color development is then carried out. Black-and-white developing solutions may contain any conventional developing agents such as dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in combination of two or more.

After color development, the photographic emulsion layer is generally bleached. Bleaching may be carried out simultaneously with fixing (bleaching-fixing treatment) and they are separately carried out. After bleaching, a bleaching-fixing treatment may be conducted to expedite processing. Examples of bleaching agents include compounds of polyvalent metals such as iron(III), cobalt(III), chromium(VI) and copper(II), peracids, quinones and nitron compounds. Typical examples of the bleaching agents include ferricyanides; dichromates; organic complex salts of iron(III) and cobalt(III) such as complex salts of aminopolycarboxylic acids (e.g., ethylenediaminetetraacetic acid, diethyl enetriaminepentaacetic acid, nitrilotriacetic acid, 1,3-diamino-2-propanetetraacetic acid), citric acid, tartaric acid, malic acid, etc.; persulfates; permanganates; and nitrosophenols. Among them, ion(III) complex salts of ethylenediaminetetraacetic acid and ion(III) complex salts of diethylenetriaminepentaacetic acid and persulfates are preferred from the viewpoint of rapid processing and the viewpoint of prevention of environmental pollution. Further, iron(III) complex salts of ethylenediaminetetraacetic acid are useful for independent bleaching solutions and monobath bleaching-fixing solutions.

If desired, the bleaching solution, the bleaching-fixing solution and the pre-bath thereof may contain bleaching accelerators. Examples of the bleaching accelerators include the compounds having mercapto group or disulfide group described in U.S. Pat. No. 3,893,858, West German- Patents 1,290,812 and 2,059,988, JP-A-53-32736, JP-A-53-57831, JP-A-53-37418, JP-A-53-65732, JP-A-53-72623, JP-A 53-95630, JP-A-53-95631, JP-A-53-104232, JP A-53-124424, JP-A-53-141623, JP-A-53-28426 and *Research Disclosure* No. 17129 (July 1978); the thiazolidine derivatives described in JP-A-50-140129; the thiourea derivatives described in JP-B-45-8506, JP-A-52-20832, JP-A-53 32735 and U.S. Pat. No. 3,706,561; the iodides described in West German Patent 1,127,715 and JP-A-58-16235; the polyethylene oxide compounds described in West German Patents 966,410 and 2,748,430; the polyamine compounds described in JP-B-45-8836; the compounds described in JP-A-49-42434, JP-A-49-59644, JP-A-53-94927, JP-A-54 35727, JP-A-55-26506 and JP-A-58-163940; and iodide and bromide ions. Among them, the compounds having a mercapto group or a disulfide group are preferred from the viewpoint of a high accelerating effect. Particularly, the compounds described in U.S. Pat. No. 3,893,858, West German Patent 1,290,812 and JP-A-53-95630 are preferred. Further, the compounds described in U.S. Pat. No. 4,552;834 are preferred. These bleaching accelerators may be incorporated into the photographic materials. These bleaching accelerators are particularly effective in conducting the bleaching-fixing of the color photographic materials for photographing.

Examples of the fixing agents include thiosulfates, thiocyanates, thioether compounds, thioureas and large amount of iodides. Thiosulfates are widely used as the fixing agents. Sulfites, bisulfites and carbonyl bisulfite adducts are preferred as preservatives for the bleaching-fixing solutions or the fixing solutions.

Usually, a rinsing treatment and a stabilization treatment are carried out after the bleaching-fixing treatment or the fixing treatment. Various known compounds may be added to the rinsing stage and the stabilization stage to prevent precipitation or to save water. For example, water softeners such as inorganic phosphoric acid, aminopolycarboxylic acids, organic aminopolyphosphonic acids and organic phosphoric acids may be added to prevent precipitation. Germicides, antifungal agents or metal salts such as magnesium salts, aluminum salts and bismuth salts may be added to prevent bacteria, algae and mold from being grown. Surfactants may be added to prevent unevenness in drying from occurring. Further, hardening agents may be optionally added. Furthermore, the compounds described in L. E. West, *Photographic Science and Engineering*, Vol. 6, PP 344 to 359 (1965) may be added. The addition of the chelating agents and the antifungal agents is particularly effective.

Generally, the rinsing stage is carried out by a countercurrent system using two or more tanks to save water. A multi-stage countercurrent stabilization treatment stage described in JP-A-57-8543 may be carried out in place of the rinsing stage. In this stage, countercurrent baths of 2 to 9 tanks are necessary. In addition to the above-described additives, various compounds are added to the stabilization baths to stabilize image. Typical examples of such compounds include buffering agents (e.g., borates, metaborates, borax, phosphates, carbonates, potassium hydroxide, sodium hydroxide, ammonia water, monocarboxylic acids, dicarboxylic acids, polycarboxylic acids and a combination thereof) for adjusting the pH of the layer (e.g., adjusting pH to 3 to 9), and aldehydes such as formaldehyde. Further, other additives such as chelating agents (e.g., inorganic phosphoric acid, aminopolycarboxylic acids, organic phosphoric acids, organic phosphonic acids, aminopolyphosphonic acids, phosphonocarboxylic carboxylic acids, etc.), germicides (e.g., benzisothiazolinone, isothiazolone, 4-thiazolinebenzimidazole, halogenated phenols, sulfanylamide, benztriazole, etc.), surfactants, brightening agents and hardening agents may be used. Two or more kinds of compounds may be used in combination for the same or different purposes.

It is preferred that ammonium salts such as ammonium chloride, ammonium nitrate, ammonium sulfate, ammonium phosphate, ammonium sulfite and ammonium thiosulfate are added as pH adjustors for layers after processing.

In the case of color photographic materials for photographing, the rinsing-stabilization stage conventionally carried out after fixing can be replaced with the above described stabilization stage and rinsing stage (water-saving treatment). In this case, formaldehyde in the stabilization bath may be removed when magenta couplers are of the two equivalent type.

The rinsing and stabilization treatment time of the present invention varies depending on the type of the photographic materials and processing conditions, but is generally from 20 seconds to 10 minutes, preferably 20 seconds to 5 minutes.

The color developing agents may be incorporated into the silver halide color photographic materials of the present invention for the purpose of simplifying and expediting processing. It is preferred that precursors for color developing agents are used for the incorporation thereof in the photographic materials. Examples of the precursors include indoaniline compounds described in U.S. Pat. No. 3,342,597; Schiff base compounds described in U.S. Pat. No. 3,342,599, *Research Disclosure* No. 14850 (August 1976) and ibid., No. 15159 (November 1976); aldol compounds described in *Research Disclosure* No. 13924 (November 1975); metal complex salts described in U.S. Pat. No. 3,719,492; and urethane compounds described in JP-A-53-135628.

Further, one can use the salt type precursors described in JP-A-56-6235, JP-A-56-16133, JP-A-56-59232, JP-A-56-67842, JP-A-56-83734, JP-A-56-83735, JP-A-56-83736, JP-A-56-89735, JP-A-56-81837, JP-A-56-54430, JP-A-56-106241, JP-A-56-107236, JP-A-57-97531 and JP-A-57-83565.

If desired, 1-phenyl-3-pyrazolidones may be incorporated in the silver halide color photographic materials of the present invention for the purpose of accelerating color development. Typical examples of the compounds include those described in JP-A-56-64339, JP-A-57-144547, JP A-57-211147, JP-A-58-50532, JP-A-58-50536, JP-A-58-50533, JP-A-58-50534, JP-A-58-50535 and JP-A-58-115438.

In the present invention, various processing solutions are used at a temperature of 10° to 50° C. Generally, a temperature of 33° to 38° C. is used. However, it is possible that a higher temperature is used to accelerate processing and to shorten processing time, while a lower temperature is used to improve image quality and to improve the stability of the processing solutions. If desired, treatments using cobalt intensification or hydrogen peroxide intensification described in West German Patent 2,226,770 and U.S. Pat. No. 3,674,499 may be carried out to save silver.

If desired, a heater, a temperature sensor, a liquid level sensor, a circulating pump, a filter, a floating cover, a squeegee, etc., may be optionally provided within each processing bath.

In continuous processing, a replenisher for each processing solution is used to prevent the composition of each solution from being changed, whereby a constant finishing can be made. The replenishment rate can be reduced to ½ or less of the standard replenishment rate to reduce costs.

When the photographic material of the present invention is color paper, it may be subjected to bleaching-fixing treatment very generally. When the photographic material is a color photographic material for photographing, it may also be subjected to bleaching-fixing treatment, if desired.

The present invention is now illustrated in greater detail by reference to the following examples which, however, are not to be construed as limiting the invention in any way.

EXAMPLE 1

Potassium bromide, thioether ($HO(CH_2)_2S(CH_2)_2S(CH_2)_2OH$) and gelatin were added in water and dissolved. To the resulting solution kept at 70° C. with stirring, there were added an aqueous solution of silver nitrate and a mixed aqueous solution of potassium iodide and potassium bromide by means of a double jet process.

After completion of the addition, the temperature of the mixture was lowered to 35° C., and soluble salts were removed by conventional flocculation method. The temperature was then elevated to 40° C., 60 g of gelatin was added, and pH was adjusted to 6.8.

The resulting tabular silver halide grains had an average diameter of 1.25 μm, a thickness of 0.17 μm, a ratio of the average diameter/thickness of 7.4 and a silver iodide content of 3 mol %. The pAg thereof was 8.4 at 40° C.

The emulsion was divided into 19 portions. The temperature thereof was elevated to 62° C., and a sensitizing dye, sodium salt of anhydro-5,5'-dichloro-9-ethyl-3,3'-di(3-sulfopropyl)oxacarbocyanine hydroxide (500 mg/mol of AgX) and potassium iodide (200 mg/mol of AgX) were added thereto. Further, the sensitizing agents given in Table 1 were added. Furthermore, chloroauric acid ($9\times10^{-6}$ mol/mol of AgX) and potassium thiocyanate ($3.2\times10^{-4}$ mol/mol of AgX) were added, and chemical ripening was carried out for 30 minutes.

After completion of chemical ripening, 100 g (containing 0.08 mol of Ag) of each emulsion was dissolved at 40° C., and the following Compounds (1) to (4) were added in order with stirring to prepare a solution:

| | | |
|---|---|---|
| (1) | 4-Hydroxy-6-methyl-1,3,3a,7-tetrazaindene 3% | 2 ml |
| (2) | $C_{17}H_{35}—O—(CH_2CHO)_{25}—H$ 2% | 2.2 ml |

-continued

| | | |
|---|---|---|
| (3) | $\leftarrow CH_2-CH)_n$ 2% 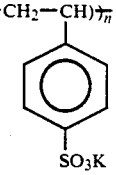 n = ca. 3000 | 1.6 ml |
| (4) | Sodium salt of 2,4-dichloro-6-hydroxy-s-triazine 2% | 3 ml |

A coating solution for a surface protective layer was prepared by adding the following Components (1) to (5) in order with stirring at 40° C.:

| | | |
|---|---|---|
| (1) | 14% aqueous solution of gelatin | 56.8 g |
| (2) | Fine particles of polymethyl methacrylate (average particle size of 3.0 μm) | 3.9 g |
| (3) | Emulsion | |
| | Gelatin 10% | 4.24 g |
| | $NaO_3S-CH(CH_2COOCH_2CH(C_2H_5)C_4H_9)COOCH_2CH(C_2H_5)C_4H_9$ | 10.6 mg |
| | 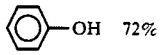 72% | 0.02 ml |
| | 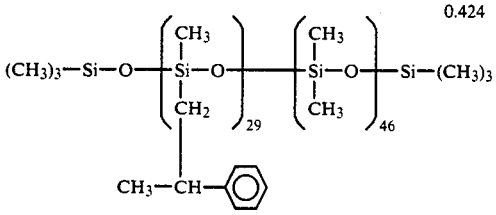 | 0.424 g |
| | $H_2O$ | 68.8 ml |
| (5) | $C_8H_{17}-C_6H_4-(OCH_2CH_2)_2CH_2CH_2SO_3Na$ 4.3% | 3 ml |

The thus-prepared coating solution for the emulsion layer and the thus-prepared coating solution for the surface protective layer were coated on a polyethylene terephthalate film in such an amount as to give a ratio by volume of 103 : 45 during coating. The coating was carried out by means of a co-extrusion method. The amount of silver coated was 2.5 g/m$^2$.

The thus-prepared samples were exposed (1/100 sec) through a yellow filter and an optical wedge by using a sensitometer, and then developed at 35° C. for 30 seconds by using a developing solution (RD-III, a product of Fuji Photo Film Co., Ltd.) for automatic processor. The samples were fixed, washed with water and dried by a conventional method.

The photographic sensitivity thereof was measured. The photographic sensitivity was represented by the relative value of the reciprocal of exposure amount giving an optical density of (Fog value+0.2). The sensitivity of Sample 1 was referred to as 100. The results are shown in Table 1.

It is apparent from Table 1 that selenium-gold sensitization using a known selenium compound and selenium-sulfur-gold sensitization using known a selenium compound cause great fogging in comparison with sulfur-gold sensitization, though the sensitization using known selenium compounds gives high sensitivity. On the other hand, when the selenium sensitizing agents of the present invention are used, they are inferior in inhibiting fogging to sulfur-gold sensitization. But fogging caused by the use of the agents of the present invention is low in comparison with conventional selenium compounds, and they give a high sensitivity substantially equal to that obtained by the use of conventional selenium compounds.

In Table 1, Compounds *1 and *2 are comparative compounds and described in U.S. Pat. No. 3,297,447.

TABLE 1

| Sample | Sensitizing agent (amount added: mol/mol of Ag) | Fog | Relative sensitivity | Remarks |
|---|---|---|---|---|
| 1 | Sodium thiosulfate ($1.8 \times 10^{-5}$) | 0.14 | 100 | Comp. Ex. |
| 2 | N,N-Dimethylselenourea ($2 \times 10^{-6}$)*1 | 0.36 | 132 | " |
| 3 | Selenoacetamide ($2 \times 10^{-6}$)*2 | 0.34 | 126 | " |
| 4 | N,N-Dimethylselenourea ($1 \times 10^{-6}$) Sodium thiosulfate ($8 \times 10^{-6}$) | 0.32 | 128 | " |
| 5 | Compound I-1 ($2 \times 10^{-6}$) | 0.26 | 128 | Invention |
| 6 | Compound I-4 ($3 \times 10^{-6}$) | 0.22 | 136 | " |
| 7 | Compound I-7 ($2.5 \times 10^{-6}$) | 0.25 | 134 | " |
| 8 | Compound I-39 ($2.5 \times 10^{-6}$) | 0.29 | 128 | " |
| 9 | Compound I-41 ($2 \times 10^{-6}$) | 0.26 | 130 | " |
| 10 | Compound I-43 ($3 \times 10^{-6}$) | 0.22 | 136 | " |
| 11 | Compound I-45 ($2.5 \times 10^{-6}$) | 0.22 | 136 | " |
| 12 | Compound II-1 ($2 \times 10^{-6}$) | 0.23 | 130 | " |
| 13 | Compound II-12 ($2 \times 10^{-6}$) | 0.26 | 128 | " |
| 14 | Compound III-23 ($2 \times 10^{-6}$) | 0.28 | 130 | " |
| 15 | Compound I-4 ($2 \times 10^{-6}$) Sodium thiosulfate ($8 \times 10^{-6}$) | 0.18 | 134 | " |
| 16 | Compound I-22 ($1 \times 10^{-6}$) Sodium thiosulfate ($8 \times 10^{-6}$) | 0.19 | 130 | " |
| 17 | Compound I-43 ($1.5 \times 10^{-6}$) Sodium thiosulfate ($8 \times 10^{-6}$) | 0.18 | 134 | " |
| 18 | Compound I-45 ($1.5 \times 10^{-6}$) Sodium thiosulfate ($8 \times 10^{-6}$) | 0.19 | 134 | " |
| 19 | Compound II-1 ($1 \times 10^{-6}$) Sodium thiosulfate ($8 \times 10^{-6}$) | 0.18 | 126 | " |

EXAMPLE 2 (silver iodobromide tabular grains)

Fine silver iodobromide grain Emulsion II-A

To 2.6 l of a 2.5 wt % gelatin solution containing 0.026 mol of potassium bromide were added 1200 ml of an aqueous solution of 1.2 mol of silver nitrate and 1200 ml of an aqueous halide solution containing 1.11 mol of potassium bromide and 0.09 mol of potassium iodide with stirring over a period of 15 minutes by means of a double jet process. The temperature of the gelatin solution was kept at 35° C. during the course of the addition. The resulting emulsion was washed by a conventional flocculation method, and 30 g of gelatin was added thereto and dissolved therein. The pH of the emulsion was adjusted to 6.5 and the pAg thereof was adjusted to 8.6. The resulting fine silver iodobromide grains (silver iodide content: 7.5%) had a mean grain size of 0.07 μm.

Tabular silver bromide core emulsion II-B

To 2 l of a 0.8 wt % gelatin solution containing 0.09 mol of potassium bromide were added 30 ml of a solution of 2.0 mol of silver nitrate and 30 ml of a solution of 2.0 mol of potassium bromide with stirring by means of a double jet process. The temperature of the gelatin solution was kept at 30° C. during the course of the addition. After the addition, the temperature was raised to 75° C., and 40 g of gelatin was added thereto. Thereafter, a solution of 1.0 mol of silver nitrate was added thereto to adjust the pBr to 2.55. Subsequently, 150 g of silver nitrate was added thereto over a period of 60 minutes at such an accelerated flow rate that the flow rate at the time of completion of the addition was 10 times that at the time of the initiation of the addition. At the same time, a potassium bromide solution was added thereto by means of a double jet process so as to give a pBr of 2.55.

The emulsion was then cooled to 35° C. and washed with water by a conventional flocculation method, and 60 g of gelatin was added thereto and dissolved therein at 40° C. The pH of the emulsion was adjusted to 6.5, and the pAg thereof was adjusted to 8.6. The resulting tabular silver bromide grains had a mean grain size of 1.4 μm in terms of the diameter of a circle and a grain thickness of 0.2 μm. They were monodisperse tabular grains having a coefficient of variation in grain size (in terms of a diameter of a circle) of 15%.

Tabular silver iodobromide emulsion II-C

The Emulsion II B containing 50 g (in terms of silver nitrate) of silver bromide was dissolved in 1.1 l of water. The temperature of the solution was kept at 75° C., and pBr was kept at 1.5. Subsequently, 1 g of 3,6-dithiaoctane-1,8-diol was added thereto. Immediately after the addition, 100 g (in terms of silver nitrate) of the fine grain Emulsion II-A was added to the reaction vessel at a given rate over a period of 50 minutes. The resulting tabular grains had a mean grain size of 2.4 μm in terms of a diameter of a circle and a grain thickness of 0.31 μm.

The emulsion was washed with water by a conventional flocculation method, the pH thereof was adjusted to 6.5 and the pAg thereof was adjusted to 8.6.

The resulting emulsion was divided into 9 portions. The temperature of the emulsion was raised to 56° C., and the sensitizing dye, sodium salt of anhydro-5-chloro-5'-phenyl-9-ethyl-3,3'-di(3-sulfopropyl)oxacarbocyanine hydroxide was added thereto. Sensitizing agents given in Table 2 were then added thereto. Further, chloroauric acid ($1\times10^{-5}$ mol/mol of AgX) and potassium thiocyanate ($6\times10^{-4}$ mol/mol of AgX) were added thereto, and the emulsion was chemical-sensitized best. The term "chemical-sensitized best" as used herein refers to such chemical sensitization that the highest sensitivity is obtained when exposure (1/100 sec) is conducted after chemical sensitization. Subsequently, the following compounds were added thereto, and the emulsion layer and the protective layer were coated on a support of triacetyl-cellulose having a subbing layer. The coating was carried out by co-extrusion method.

(I) Emulsion layer

Emulsion: the emulsion given in Table 2

Coupler:

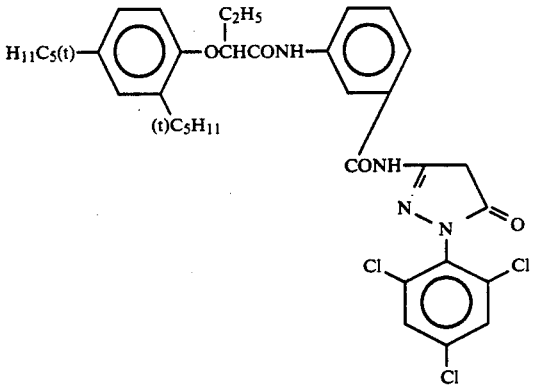

Stabilizer: 4-hydroxy-6-methyl-1,3,3a,7-tetra azaindene

Coating aid: sodium dodecylbenzenesulfonate (II) Protective layer

Fine particles of polymethyl methacrylate Sodium salt of 2,4-dichloro-6-hydroxy-s-triazine Gelatin The resulting samples were exposed (1/100 sec) to conduct sensitometry. The exposed samples were subjected to the following color development.

The density of each of the processed samples was measured through a green filter. The results of their photographic performance are shown in Table 2. The sensitivity in terms of relative sensitivity is shown in Table 2in which the sensitivity of the sample 20 is referred to as 100.

The development was carried out at 38° C. under the following conditions:

| | |
|---|---|
| 1 Color development | 2 min 45 sec |
| 2 Bleaching | 6 min 30 sec |
| 3 Rinsing | 3 min 15 sec |
| 4 Fixing | 6 min 30 sec |
| 5 Rinsing | 3 min 15 sec |
| 6 Stabilization | 3 min 15 sec |

Each processing solution had the following composition.

| | |
|---|---|
| Color developing solution | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N-Ethyl-N-β-hydroxyethyl-amino)-2-methylaniline sulfate | 4.5 g |
| Water to make | 1 liter |
| Bleaching solution | |
| Ammonium bromide | 160.0 g |
| Ammonia water (28%) | 25.0 ml |
| Sodium ethylenediaminetetraacetato ferrate | 130 g |

-continued

| | |
|---|---|
| Glacial acetic acid | 14 ml |
| Water to make | 1 liter |
| Fixing solution | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1.0 liter |
| Stabilizing solution | |
| Formalin | 8.0 ml |
| Water to make | 1 liter |

TABLE 2

| Sample | Sensitizing agent (amount added: mol/mol of Ag) | Fog | Relative sensitivity | Remarks |
|---|---|---|---|---|
| 20 | Sodium thiosulfate ($1.2 \times 10^{-5}$) | 0.28 | 100 | Comp. Ex. |
| 21 | N,N-Dimethylselenourea ($2 \times 10^{-6}$)*1 | 0.65 | 126 | " |
| 22 | Selenoacetamide ($2 \times 10^{-6}$)*2 | 0.61 | 123 | " |
| 23 | Compound I-4 ($3 \times 10^{-6}$) | 0.31 | 126 | Invention |
| 24 | Compound I-43 ($3 \times 10^{-6}$) | 0.32 | 126 | " |
| 25 | Compound I-45 ($2.5 \times 10^{-6}$) | 0.31 | 125 | " |
| 26 | Compound II-1 ($3 \times 10^{-6}$) | 0.35 | 122 | " |
| 27 | Compound II-43 ($2 \times 10^{-6}$) | 0.37 | 120 | " |
| 28 | Compound III-23 ($2 \times 10^{-6}$) | 0.38 | 120 | " |

(Comparative compounds *1 and *2 in Table 2 are the same compounds as those in Table 1)

It is apparent from Table 2 that when selenium sensitization is carried out by using known selenium compounds, great fogging is caused during color development, though high sensitivity can be obtained. On the other hand, when the selenium sensitizing agents of the present invention are used, fogging can be greatly inhibited and high sensitivity substantially equal to that obtained by known selenium compounds can be achieved.

EXAMPLE 3

Preparation of Em-H

One thousand ml of an aqueous solution containing 7.0 g of gelatin and 4.5 g of KBr was stirred at 30° C., and an aqueous solution of $AgNO_3$ (7.3 g) and an aqueous solution of KBr (5.3 g) were added thereto by means of a double jet process. Gelatin was added thereto, and the temperature of the mixture was raised to 75° C. After the potential was adjusted to −30 mV, an aqueous solution of $AgNO_3$ (160.3 g) and an aqueous solution of KBr (containing 10.9 mol % of KI) were added thereto by means of a double jet process. In this case, silver potential to a saturated calomel electrode was kept at −30 mV. After the silver potential was adjusted to 0 mV, the temperature was lowered to 40° C., and an aqueous solution of silver nitrate ($AgNO_3$: 8.2 g) and an aqueous solution of KI (6.1 g) were added over a period of 5 minutes. After $K_3IrCl_6$ ($1.8 \times 10^{-6}$ mol/mol of Ag) was added, an aqueous silver nitrate solution ($AgNO_3$: 65.9 g) and an aqueous KBr solution were added over a period of 27 minutes by means of a double jet process. In this case, the silver potential to a saturated calomel electrode was kept at −50 mV.

After 15 ml of 0.1 N potassium thiocyanate was added, desalting was carried out by flocculation method. Gelatin was added, the pH of the emulsion was adjusted to 6.2 and the pAg was adjusted to 8.0. The resulting emulsion comprised tabular grains having a mean grain size of 1.25 μm in terms of a diameter of a circle, an average thickness of 0.25 μm and an average aspect ratio of 5.3. The coefficient of variation in grain size (in terms of a diameter of a circle) was 24%.

The gold sulfur-selenium sensitization of Em-H was carried out in the following manner. The temperature of the emulsion was elevated to 64° C. The sensitizing dye III ($3.3 \times 10^{-4}$ mol/mol of Ag) given in Table A, the sensitizing dye I ($3.2 \times 10^{-4}$ mol/mol of Ag) given in Table A, the sensitizing dye II ($1.7 \times 10^{-5}$ mol/mol of Ag) given in Table A, compound Ex-14 ($6 \times 10^{-5}$ mol/mol of Ag) given in Table A, sodium thiosulfate ($2.3 \times 10^{-6}$ mol/mol of Ag), chloroauric acid ($9.2 \times 10^{-6}$ mol/mol of Ag), potassium thiocyanate ($6.0 \times 10^{-3}$ mol/mol of Ag) and sensitizing agents given in Table 3 were added to the emulsion. The emulsion was chemical-sensitized best. The term "chemical-sensitized best" as used herein refers to such chemical sensitization that the highest sensitivity is obtained when exposure (1/100 sec) is conducted after chemical sensitization.

A cellulose triacetate film support having a subbing layer was coated with the following layers having the following compositions to prepare each of multi-layer color photographic materials as Samples 29 to 37.

Composition of light-sensitive layer

Numerals given to ingredients represent coating weight in g/m². The amount of silver halide is represented by coating weight in terms of silver. The amounts of the sensitizing dyes are represented by moles per one mole of silver halide in the same layer. The structures of compounds added are shown in Table A.

| | |
|---|---|
| First layer (antihalation layer) | |
| Black colloidal silver (in terms of silver) | 0.18 |
| Gelatin | 1.40 |
| Second layer (interlayer) | |
| 2,5-Di-t-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 1.04 |
| Third layer (donor layer having an interlayer effect on red-sensitive layer) | |
| Emulsion 9 (in terms of silver) | 1.2 |
| Emulsion 10 (in terms of silver) | 2.0 |
| Sensitizing dye IV | $4 \times 10^{-4}$ |
| EX-10 | 0.10 |
| HBS-1 | 0.10 |
| HBS-2 | 0.10 |
| Gelatin | 2.82 |
| Fourth layer (interlayer) | |
| EX-5 | 0.040 |
| HBS-1 | 0.020 |
| Gelatin | 0.80 |

-continued

| | |
|---|---|
| Fifth layer (first red-sensitive emulsion layer) | |
| Emulsion 1 (in terms of silver) | 0.25 |
| Emulsion 2 (in terms of silver) | 0.25 |
| Sensitizing dye I | $1.5 \times 10^{-4}$ |
| Sensitizing dye II | $1.8 \times 10^{-5}$ |
| Sensitizing dye III | $2.5 \times 10^{-4}$ |
| EX-2 | 0.335 |
| EX-10 | 0.020 |
| U-1 | 0.07 |
| U-2 | 0.05 |
| U-3 | 0.07 |
| HBS-1 | 0.060 |
| Gelatin | 0.87 |
| Sixth layer (second red-sensitive emulsion layer) | |
| Emulsion 6 (in terms of silver) | 1.0 |
| Sensitizing dye I | $1.0 \times 10^{-4}$ |
| Sensitizing dye II | $1.4 \times 10^{-5}$ |
| Sensitizing dye III | $2.0 \times 10^{-4}$ |
| EX-2 | 0.400 |
| EX 3 | 0.050 |
| EX-10 | 0.015 |
| U-1 | 0.07 |
| U-2 | 0.05 |
| U-3 | 0.07 |
| Gelatin | 1.30 |
| Seventh layer (third red-sensitive layer) | |
| Em-H (in terms of silver) | 1.60 |
| EX-3 | 0.010 |
| EX-4 | 0.080 |
| EX-2 | 0.097 |
| EX-8 | 0.080 |
| HBS-1 | 0.22 |
| HBS-2 | 0.10 |
| Gelatin | 1.63 |
| Eighth layer (interlayer) | |
| EX-5 | 0.040 |
| HBS-1 | 0.020 |
| Gelatin | 0.80 |
| Ninth layer (first green-sensitive emulsion layer) | |
| Emulsion 1 (in terms of silver) | 0.15 |
| Emulsion 2 (in terms of silver) | 0.15 |
| Sensitizing dye V | $3.0 \times 10^{-5}$ |
| Sensitizing dye VI | $1.0 \times 10^{-4}$ |
| Sensitizing dye VII | $3.8 \times 10^{-4}$ |
| Sensitizing dye IV | $5.0 \times 10^{-5}$ |
| EX-6 | 0.260 |
| EX-1 | 0.021 |
| EX-7 | 0.030 |
| EX-8 | 0.005 |
| HBS-1 | 0.100 |
| HBS-3 | 0.010 |
| Gelatin | 0.63 |
| Tenth layer (second green-sensitive emulsion layer) | |
| Emulsion 3 (in terms of silver) | 0.45 |
| Sensitizing dye V | $2.1 \times 10^{-5}$ |
| Sensitizing dye VI | $7.0 \times 10^{-5}$ |
| Sensitizing dye VII | $2.6 \times 10^{-4}$ |
| Sensitizing dye IV | $5.0 \times 10^{-5}$ |
| EX-6 | 0.094 |
| EX-22 | 0.018 |
| EX-7 | 0.026 |
| HBS-1 | 0.160 |
| HBS-3 | 0.008 |

-continued

| | |
|---|---|
| Gelatin | 0.50 |
| Eleventh layer (third green-sensitive emulsion layer) | |
| Emulsion 4 (in terms of silver) | 1.2 |
| Sensitizing dye V | $3.5 \times 10^{-5}$ |
| Sensitizing dye VI | $8.0 \times 10^{-5}$ |
| Sensitizing dye VII | $3.0 \times 10^{-4}$ |
| Sensitizing dye IV | $0.5 \times 10^{-5}$ |
| EX-13 | 0.015 |
| EX-11 | 0.100 |
| EX-1 | 0.025 |
| HBS-1 | 0.25 |
| HBS-2 | 0.10 |
| Gelatin | 1.54 |
| Twelfth layer (yellow filter layer) | |
| Yellow colloidal silver (in terms of silver) | 0.05 |
| EX-5 | 0.08 |
| HBS-1 | 0.03 |
| Gelatin | 0.95 |
| Thirteenth layer (first blue-sensitive emulsion layer) | |
| Emulsion 1 (in terms of silver) | 0.08 |
| Emulsion 2 (in terms of silver) | 0.07 |
| Emulsion 5 (in terms of silver) | 0.07 |
| Sensitizing dye VIII | $3.5 \times 10^{-4}$ |
| EX-9 | 0.721 |
| EX-8 | 0.042 |
| HBS-1 | 0.28 |
| Gelatin | 1.10 |
| Fourteenth layer (second blue-sensitive emulsion layer) | |
| Emulsion 6 (in terms of silver) | 0.45 |
| Sensitizing dye VIII | $2.1 \times 10^{-4}$ |
| EX-9 | 0.154 |
| EX-10 | 0.007 |
| HBS-1 | 0.05 |
| Gelatin | 0.78 |
| Fifteenth layer (third blue-sensitive emulsion layer) | |
| Emulsion 7 (in terms of silver) | 0.77 |
| Sensitizing dye VIII | $2.2 \times 10^{-4}$ |
| EX-9 | 0.20 |
| HBS-1 | 0.07 |
| Gelatin | 0.69 |
| Sixteenth layer (first protective layer) | |
| Emulsion 8 (in terms of silver) | 0.20 |
| U-4 | 0.11 |
| U-5 | 0.17 |
| HBS-1 | 0.05 |
| Gelatin | 1.00 |
| Seventeenth layer (second protective layer) | |
| Polymethyl acrylate particles (diameter: about 1.5 μm) | 0.54 |
| S-1 | 0.20 |
| Gelatin | 1.20 |

In addition to the above-described ingredients, a hardening agent H-1 for gelatin, Ex-14 to Ex-21 and a surfactant were added to each layer.

| | Average AgI content (%) | Mean grain size (μm) | Coefficient of variation in grain size (%) | Ratio of diameter/thickness | Ratio of amount of silver (AgI content %) |
|---|---|---|---|---|---|
| Emulsion 1 | 4.0 | 0.45 | 27 | 1 | core/shell = 1/3(13/1), double structural grains |
| Emulsion 2 | 8.9 | 0.70 | 14 | 1 | core/shell = 3/7(25/2), double structural grains |
| Emulsion 3 | 10 | 0.75 | 30 | 2 | core/shell = 1/2(24/3), double structural grains |
| Emulsion 4 | 10 | 1.05 | 35 | 3 | core/shell = 1/2(24/3), double structural grains |
| Emulsion 5 | 4.0 | 0.25 | 28 | 1 | core/shell = 1/3(13/1), double structural grains |
| Emulsion 6 | 14.0 | 0.75 | 25 | 2 | core/shell = 1/2(42/0), double structural grains |
| Emulsion 7 | 14.5 | 1.30 | 25 | 3 | core/shell = 37/63(34/3), double structural grains |
| Emulsion 8 | 1 | 0.07 | 15 | 1 | uniform grains |
| Emulsion 9 | 5 | 0.90 | 30 | 2 | core/shell = 1/1(10/0), double structural grains |
| Emulsion 10 | 7 | 1.50 | 25 | 2 | core/shell = 1/1(14/0), double structural grains |

The thus-prepared color photographic materials 29 to 37 were exposed and then processed (until the accumulated amount of the replenishment rate of the bleaching solution reached three times the tank capacity of the mother solution thereof) in the following manner by using an automatic processor.

| Stage | Processing time | Processing temp. | Replenishment rate | Tank capacity |
|---|---|---|---|---|
| | Processing method | | | |
| Color development | 3 min. 15 sec. | 38° C. | 15 ml | 20 l |
| Bleaching | 6 min. 30 sec. | 38° C. | 10 ml | 40 l |
| Rinse | 2 min. 10 sec. | 35° C. | 10 ml | 20 l |
| Fixing | 4 min. 20 sec. | 38° C. | 20 ml | 30 l |
| Rinse (1) | 1 min. 05 sec. | 35° C. | Counter-current system of from (2) to (1) | 10 l |
| Rinse (2) | 1 min. 00 sec. | 35° C. | 20 ml | 10 l |
| Stabilization | 1 min. 05 sec. | 38° C. | 10 ml | 10 l |
| Drying | 4 min. 20 sec. | 55° C. | | |

* Replenishment rate being per 1-m long by 35-mm wide

Each processing solution had the following composition:

| | Mother Solution (g) | Replenisher (g) |
|---|---|---|
| Color developing solution | | |
| Diethylenetriaminepenta-acetic acid | 1.0 | 1.1 |
| 1-Hydroxyethylidene-1,1-diphosphonic acid | 3.0 | 3.2 |
| Sodium sulfite | 4.0 | 4.9 |
| Potassium carbonate | 30.0 | 30.0 |
| Potassium bromide | 1.4 | — |
| Potassium iodide | 1.5 mg | — |
| Hydroxylamine sulfate | 2.4 | 3.6 |
| 4-(N-Ethyl-N-β-hydroxy-ethylamino)-2-methyl-aniline sulfate | 4.5 | 7.2 |
| Water to make | 1.0 l | 1.0 l |
| pH | 10.05 | 10.10 |
| Bleaching solution | | |
| Sodium ethylenediaminetetra-acetato ferrate trihydrate | 100.0 | 140.0 |
| Disodium ethylenediamine tetraacetate | 10.0 | 11.0 |
| Ammonium bromide | 140.0 | 180.0 |
| Ammonium nitrate | 30.0 | 40.0 |
| Ammonia water (27%) | 6.5 ml | 2.5 ml |
| Water to make | 1.0 l | 1.0 l |
| pH | 6.0 | 5.5 |
| Fixing Solution | | |
| Disodium ethylenediamine-tetraacetate | 0.5 | 1.0 |
| Sodium sulfite | 7.0 | 12.0 |

-continued

| | Mother Solution (g) | Replenisher (g) |
|---|---|---|
| Sodium bisulfite | 5.0 | 9.5 |
| Aqueous solution of ammonium thiosulfate (70%) | 170.0 ml | 240.0 ml |
| Water to make | 1.0 l | 1.0 l |
| pH | 6.7 | 6.5 |

Rinsing Solution

The mother solution and the replenisher were the same.

Tap water was passed through a mixed bed column packed with H type strongly acidic cation exchange resin (Amberlite IR-120B, a product of Rohm & Hass Co.) and OH type anion exchange resin (Amberlite IR-400) to reduce the concentration of each of calcium and magnesium ions to a level not higher than 3 mg/l. Subsequently, sodium dichloroisocyanurate (20 mg/l) and sodium sulfate (1.5 g/l) were added thereto. The pH of the solution was in the range of 6.5 to 7.5.

| Fixing solution | Mother Solution (g) | Replenisher (g) |
|---|---|---|
| Formalin (37%) | 2.0 ml | 3.0 ml |
| Polyoxyethylene p-monononyl-phenyl ether(average degree of polymerization: 10) | 0.3 | 0.45 |
| Disodium ethylenediamine tetraacetate | 0.05 | 0.08 |
| Water to make | 1.0 l | 1.0 l |
| pH | 5.0~8.0 | 5.0~8.0 |

Fog density is determined on the characteristic curve of cyan dye image, and sensitivity is represented by the relative value of the reciprocal of exposure amount giving a density higher by 0.1 than the fog density. The results are shown in Table 3.

TABLE 3

| Sample | Sensitizing agent (amount added: mol/mol of Ag) | Fog | Relative sensitivity | Remarks |
|---|---|---|---|---|
| 29 | N,N-dimethylselenourea ($2 \times 10^{-6}$)*1 | 0.18 | 100 | Comp. Ex. |
| 30 | Selenoacetamide ($2 \times 10^{-6}$)*2 | 0.17 | 97 | " |
| 31 | Compound I-1 ($2 \times 10^{-6}$) | 0.11 | 98 | Invention |
| 32 | Compound I-4 ($2 \times 10^{-6}$) | 0.08 | 104 | " |
| 33 | Compound I-7 ($3 \times 10^{-6}$) | 0.10 | 100 | " |
| 34 | Compound I-43 ($2.5 \times 10^{-6}$) | 0.09 | 104 | " |
| 35 | Compound I-45 ($2.5 \times 10^{-6}$) | 0.08 | 103 | " |
| 36 | Compound II-12 ($2 \times 10^{-6}$) | 0.13 | 98 | " |
| 37 | Compound III-23 ($2 \times 10^{-6}$) | 0.11 | 94 | " |

*(Comparative compounds *1 and *2 are the same as those in Table 1)

It is apparent from Table 3 that the fog of the emulsions of the present invention is low and the sensitivity thereof is substantially equal to that of the emulsions containing conventional compounds. It is very important in the art that fogging be inhibited to low level.

Even when the emulsions 1 and 2 comprising regular double structural grains having a ratio of diameter/-thickness of 1 were used in place of the Emulsion E, emulsions sensitized with selenium-sulfur-gold, which exhibited low fogging were obtained.

TABLE A
EX-1
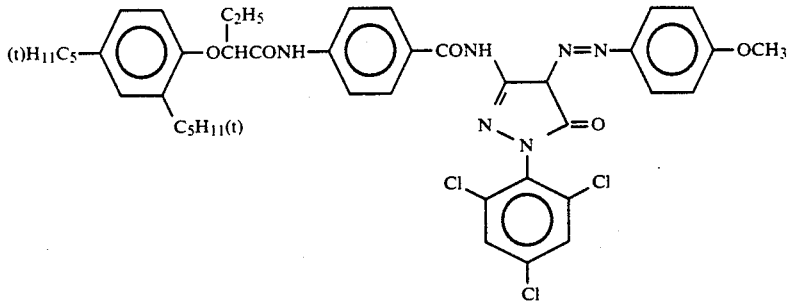
EX-2
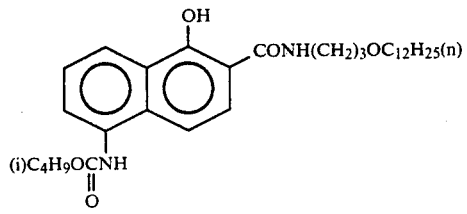
EX-3
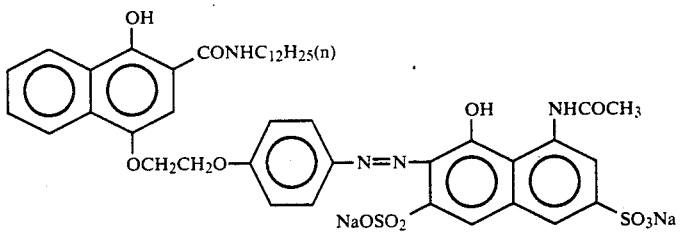
EX-4
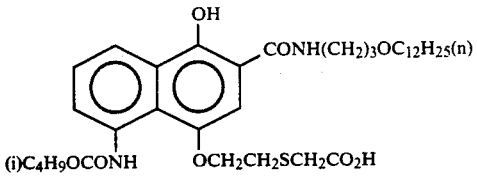
EX-5
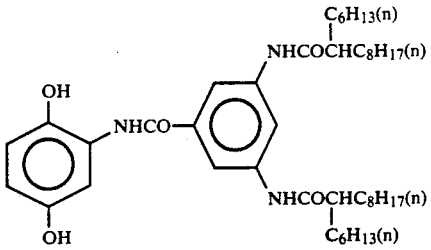
EX-6
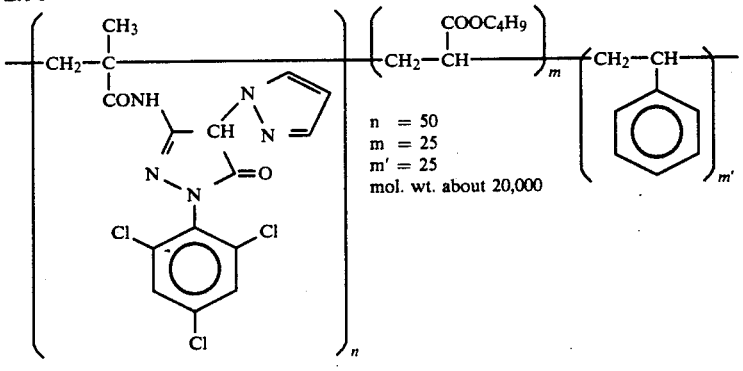

TABLE A-continued
EX-7
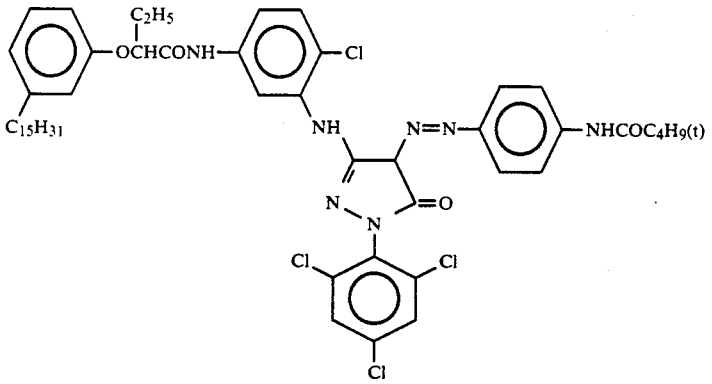
EX-8
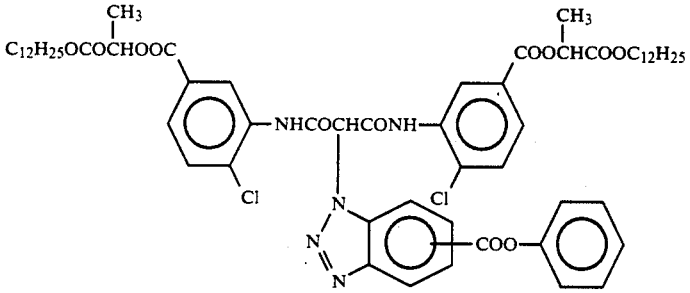
EX-9
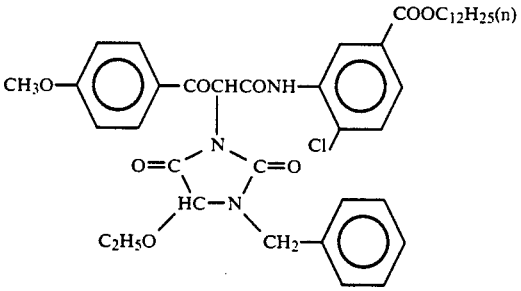
EX-12
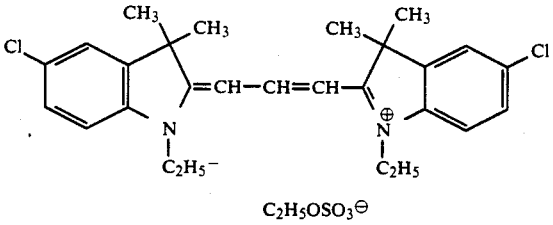
EX-13
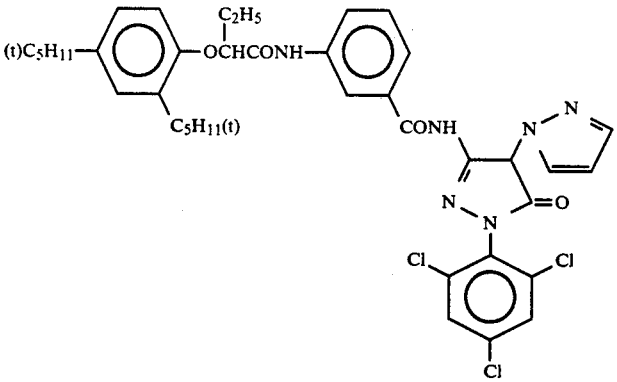
U-1
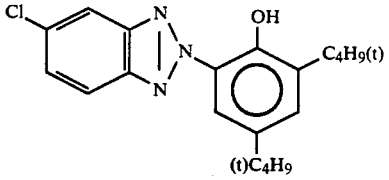
U-2
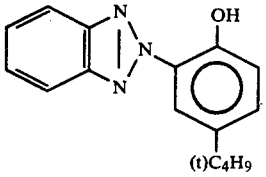
U-3
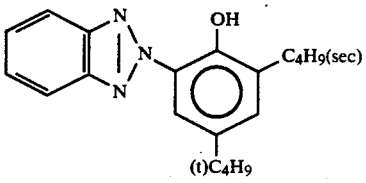

TABLE A-continued
U-4
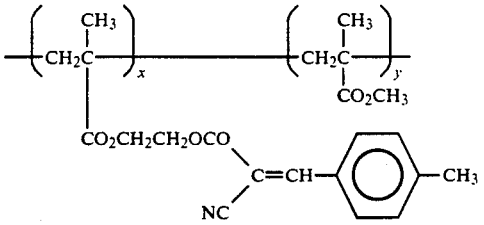
x:y = 70:30 (wt %)
UV-5
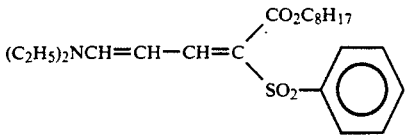
HBS-1
Tricresyl phosphate
HBS-2
Di-n-butyl phthalate
HBS-3
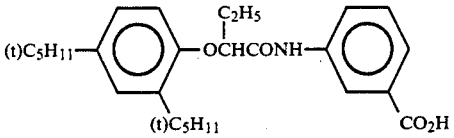
Sensitizing Dye I
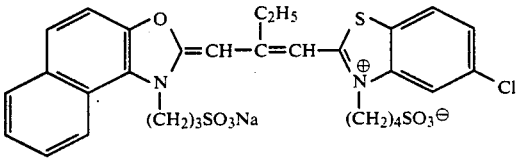
Sensitizing Dye II
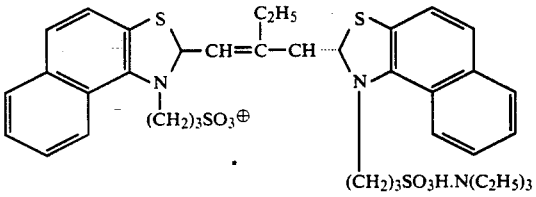
Sensitizing Dye III
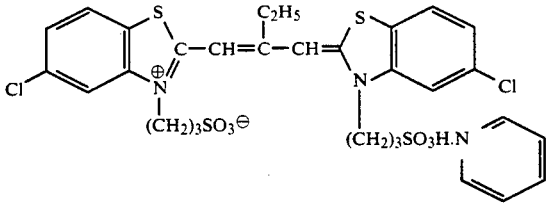
Sensitizing Dye IV
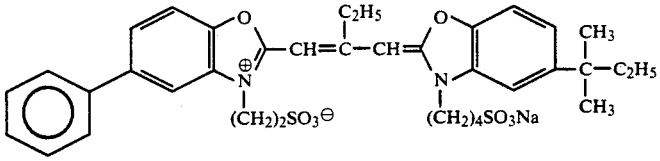
Sensitizing Dye V
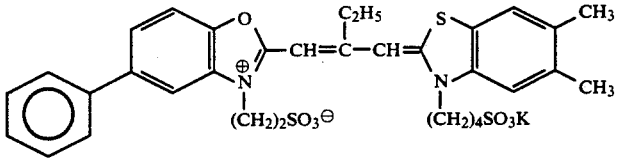
Sensitizing Dye VI
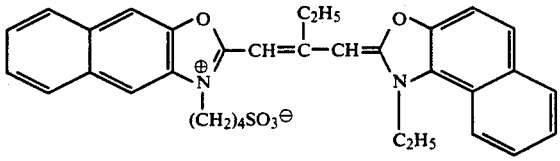

TABLE A-continued

Sensitizing Dye VII

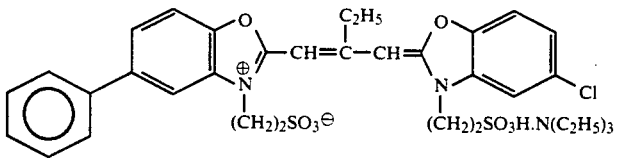

Sensitizing Dye VIII

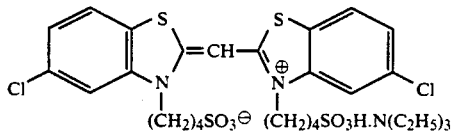

S-1

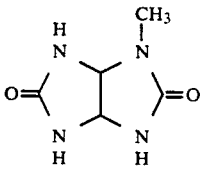

H-1

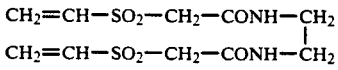

Ex-14

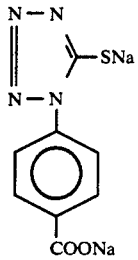

Ex-15

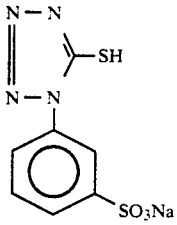

Ex-16

Copolymer of polyvinyl pyrrolidone and polyvinyl alcohol

Ex-17

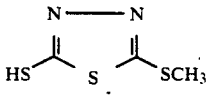

Ex-18

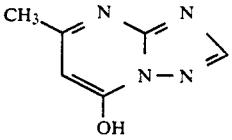

Ex-19

1,2-Benzisothiazoline-3-one

Ex-20 n-Butyl p-hydroxybenzoate

Ex-21

2-Phenoxyethanol

Ex-22

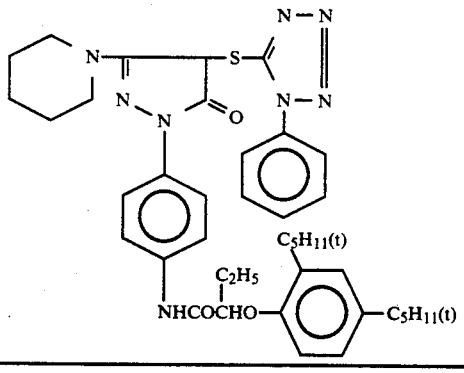

According to the present invention, fogging can be inhibited, in comparison to selenium sensitization using conventional selenium compounds, and a high sensitivity substantially equal to that obtained by conventional selenium compounds can be achieved.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, characterized in that at least one silver halide emulsion layer contains at least one compound represented by the following general formula (I), (II) or (III):

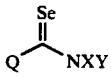

(I)

wherein Q represents an alkyl group, a cycloalkyl group, an alkenyl group, an alkynyl group, an aralkyl group, an aryl group or a heterocyclic group; X represents an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group or a sulfonyl group; Y represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group or a sulfonyl group; and Q and X, X and Y or Y and Q may be combined together to form a ring,

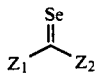

(II)

wherein $Z_1$ represents $-OR_1$, $-SR_2$, $-SeR_3$, or

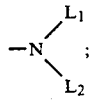

$Z_2$ represents $-OR_4$, $-SR_5$ or $-SeR_6$; $R_1$, $R_2$, $R_3$, $R_4$, $R_5$ and $R_6$ each represents an alkyl group, a cycloalkyl group, an alkenyl group, an alkynyl group, an aralkyl group, an aryl group or a heterocyclic group; $L_1$ and $L_2$ each represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group, a sulfonyl group or an amino group; and $Z_1$ and $Z_2$ or $L_1$ and $L_2$ may be combined together to form a ring,

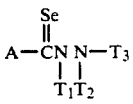

(III)

wherein A represents an alkyl group, a cycloalkyl group, an alkenyl group, an alkynyl group, an aralkyl group, an aryl group, a heterocyclic group, an amino group or a hydrazino group; $T_1$, $T_2$ and $T_3$ each represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group or a sulfonyl group; and any two of A, $T_1$, $T_2$ and $T_3$ may be combined together to form a ring.

2. The silver halide photographic material of claim 1, wherein the at least one compound is represented by general formula (I).

3. The silver halide photographic material of claim 2, wherein Q is a substituted or unsubstituted alkyl group or a substituted or unsubstituted aryl group, X is a substituted or unsubstituted alkyl group or a substituted or unsubstituted aryl group, and Y is a substituted or unsubstituted alkyl group, a substituted or unsubstituted aryl group or a substituted or unsubstituted acyl group.

4. The silver halide photographic material of claim 1, wherein the at least one compound is represented by general formula (II).

5. The silver halide photographic material of claim 4, wherein $Z_1$ is $-OR_1$, $-SR_2$ or

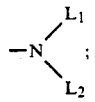

and $Z_2$is $-OR_4$ or $-SR_5$, wherein $R_1$, $R_2$, $R_4$ and $R_5$ each represents a substituted or unsubstituted alkyl group, a substituted or unsubstituted aralkyl group, a substituted or unsubstituted aryl group, or a substituted or unsubstituted heterocyclic group; and $L_2$ and $L_2$ each represents a hydrogen atom, a substituted or unsubstituted alkyl group, a substituted or unsubstituted aralkyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, or a substituted or unsubstituted carbamoyl group.

6. The silver halide photographic material of claim 4, wherein $Z_1$ is

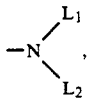

and $Z_2$ is $-OR_4$ or $-SR_5$, wherein $R_4$ and $R_5$ each represents a substituted or unsubstituted alkyl group or a substituted or unsubstituted aryl group, and $L_1$ and $L_2$ each represents a substituted or unsubstituted alkyl group, a substituted or unsubstituted aryl group or a substituted or unsubstituted acyl group.

7. The silver halide photographic material of claim 1, wherein the at least one compound is represented by general formula (III).

8. The silver halide photographic material of claim 7 wherein A is a substituted or unsubstituted alkyl group, a substituted or unsubstituted aralkyl group, a substituted or unsubstituted aryl group, or a substituted or unsubstituted heterocyclic group; and $T_1$, $T_2$ and $T_3$ each represents a hydrogen atom, a substituted or unsubstituted alkyl group, a substituted or unsubstituted aralkyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, or a substituted or unsubstituted carbamoyl group.

9. The silver halide photographic material of claim 1, wherein said at least one silver halide emulsion layer further contains at least one noble metal sensitizing agent.

10. The silver halide photographic material of claim 9, wherein said noble metal sensitizing agent is selected from the group consisting of a gold compound, a platinum compound, a palladium compound and an iridium compound.

11. The silver halide photographic material of claim 10, wherein said noble metal sensitizing agent is selected from the group consisting of chloroauric acid, potassium chloroaurate, potassium aurithiocyanate, gold sulfide and gold selenide.

12. The silver halide photographic material of claim 1, wherein said at least one silver halide emulsion layer further contains at least one sulfur sensitizing agent simultaneously with said at least one compound represented by the general formula (I), (II) or (III) as shown above.

13. The silver halide photographic material of claim 12, wherein said sulfur sensitizing agent is selected from the group consisting of thiosulfates, thioureas and rhodanine compounds.

14. The silver halide photographic material of claim 13, wherein said sulfur sensitizing agent is selected from the group consisting of hypo, diphenylthiourea, triethylthiourea and allylthiourea.

15. The silver halide photographic material of claim 1, wherein said at least one compound represented by the general formula (I), (II) or (III) as shown above is contained in the presence of a solvent for silver halide.

16. The silver halide photographic material of claim 15, wherein said solvent for silver halide is a thiocyanate.

17. The silver halide photographic material of claim 1, wherein said at least one silver halide emulsion layer comprises tabular grain emulsions.

18. The silver halide photographic material of claim 1, wherein said at least one silver halide emulsion layer comprises silver halide grains which have been prepared in the coexistence of an iridium salt or a complex salt thereof during the formation of the silver halide grains or during the physical ripening thereof.

19. The silver halide photographic material of claim 1, wherein said at least one silver halide emulsion layer comprises silver halide grains which have been spectral-sensitized with a methine dye.

20. A silver halide photographic material which contains a silver halide emulsion which has been selenium-sensitized with at least one compound represented by the following general formula (I), (II) or (III):

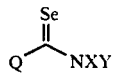

(I)

wherein Q represents an alkyl group, a cycloalkyl group, an alkenyl group, an alkynyl group, an aralkyl group, an aryl group or a heterocyclic group; X represents an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group or a sulfonyl group; Y represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group or a sulfonyl group; and Q and X, X and Y or Y and Q may be combined together to form a ring,

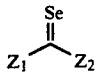

(II)

wherein $Z_1$ represents —$OR_1$, —$SR_2$, —$SeR_3$, or

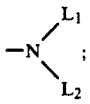

$Z_2$ represents —$OR_4$, —$SR_5$ or —$SeR_6$; $R_1$, $R_2$, $R_3$, $R_4$, $R_5$ and $R_6$ each represents an alkyl group, a cycloalkyl group, an alkenyl group, an alkynyl group, an aralkyl group, an aryl group or a heterocyclic group; $L_1$ and $L_2$ each represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group, a sulfonyl group or an amino group; and $Z_1$ and $Z_2$ or $L_1$ and $L_2$ may be combined together to form a ring,

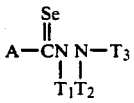

(III)

wherein A represents an alkyl group, a cycloalkyl group, an alkenyl group, an alkynyl group, an aralkyl group, an aryl group, a heterocyclic group, an amino group or a hydrazino group; $T_1$, $T_2$ and $T_3$ each represents a hydrogen atom, an alkyl group, a cycloalkyl group, an alkenyl group, an alkynyl group, an aralkyl group, an aryl group, a heterocyclic group, an acyl group, an alkoxycarbonyl group, an aryloxycarbonyl group, a carbamoyl group, a sulfamoyl group or a sulfonyl group; and any two of A, $T_1$, $T_2$ and $T_3$ may be combined together to form a ring.

21. The silver halide photographic material of claim 20, wherein the at least one compound is represented by general formula (I).

22. The silver halide photographic material of claim 21, wherein Q is a substituted or unsubstituted alkyl group or a substituted or unsubstituted aryl group, X is a substituted or unsubstituted alkyl group or a substituted or unsubstituted aryl group, and Y is a substituted or unsubstituted alkyl group, a substituted or unsubstituted aryl group or a substituted or unsubstituted acyl group.

23. The silver halide photographic material of claim 20, wherein the at least one compound is represented by general formula (II).

24. The silver halide photographic material of claim 23, wherein $Z_1$ is —$OR_1$, —$SR_2$ or

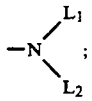

and $Z_2$ is —$OR_4$ or —$SR_5$, wherein $R_1$, $R_2$, $R_4$ and $R_5$ each represents a substituted or unsubstituted alkyl group, a substituted or unsubstituted aralkyl group, a substituted or unsubstituted aryl group, or a substituted or unsubstituted heterocyclic group; and $L_1$ and $L_2$ each represents a hydrogen atom, a substituted or unsubstituted alkyl group, a substituted or unsubstituted aralkyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, or a substituted or unsubstituted carbamoyl group.

25. The silver halide photographic material of claim 23, wherein $Z_1$ is

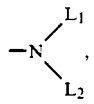

and $Z_2$ is $—OR_4$ or $—SR_5$, wherein $R_4$ and $R_5$ each represents a substituted or unsubstituted alkyl group or a substituted or unsubstituted aryl group, and $L_1$ and $L_2$ each represents a substituted or unsubstituted alkyl group, a substituted or unsubstituted aryl group or a substituted or unsubstituted acyl group.

26. The silver halide photographic material of claim 20, wherein the at least one compound is represented by general formula (III).

27. The silver halide photographic material of claim 26, wherein A is a substituted or unsubstituted alkyl group, a substituted or unsubstituted aralkyl group, a substituted or unsubstituted aryl group, or a substituted or unsubstituted heterocyclic group; and $T_1$, $T_2$ and $T_3$ each represents a hydrogen atom, a substituted or unsubstituted alkyl group, a substituted or unsubstituted aralkyl group, a substituted or unsubstituted aryl group, a substituted or unsubstituted heterocyclic group, a substituted or unsubstituted acyl group, a substituted or unsubstituted alkoxycarbonyl group, a substituted or unsubstituted aryloxycarbonyl group, or a substituted or unsubstituted carbamoyl group.

28. The silver halide photographic material of claim 20, wherein said silver halide emulsion has been further sensitized with at least one noble metal sensitizing agent.

29. The silver halide photographic material of claim 28, wherein said noble metal sensitizing agent is selected from the group consisting of a gold compound, a platinum compound, a palladium compound and an iridium compound.

30. The silver halide photographic material of claim 29, wherein said noble metal sensitizing agent is selected from the group consisting of chloroauric acid, potassium chloroaurate, potassium aurithiocyanate, gold sulfide and gold selenide.

31. The silver halide photographic material of claim 20, wherein at least one sulfur sensitizing agent is used together with said at least one compound represented by the general formula (I), (II) or (III) as shown above.

32. The silver halide photographic material of claim 31, wherein said sulfur sensitizing agent is selected from the group consisting of thiosulfates, thioureas and rhodanine compounds.

33. The silver halide photographic material of claim 32, wherein said sulfur sensitizing agent is selected from the group consisting of hypo, diphenylthiourea, triethylthiourea and allylthiourea.

34. The silver halide photographic material of claim 20, wherein the selenium sensitization is conducted in the presence of a solvent for silver halide.

35. The silver halide photographic material of claim 34, wherein said solvent for silver halide is a thiocyanate.

36. The silver halide photographic material of claim 20, wherein said silver halide emulsion is a tabular grain emulsion.

37. The silver halide photographic material of claim 20, wherein said silver halide emulsion comprises silver halide grains which have been prepared in the coexistence of an iridium salt or a complex salt thereof during the formation of the silver halide grains or during the physical ripening thereof.

38. The silver halide photographic material of claim 20, wherein said-silver halide emulsion comprises silver halide grains which have been spectral-sensitized with a methine dye.

* * * * *